US007302941B2

(12) United States Patent
Honda et al.

(10) Patent No.: US 7,302,941 B2
(45) Date of Patent: Dec. 4, 2007

(54) AIR-FUEL RATIO CONTROL APPARATUS FOR INTERNAL COMBUSTION ENGINE

(75) Inventors: Koji Honda, Toyota (JP); Seiji Hirowatari, Toyota (JP); Masanao Idogawa, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 25 days.

(21) Appl. No.: 11/303,963

(22) Filed: Dec. 19, 2005

(65) Prior Publication Data

US 2006/0137668 A1 Jun. 29, 2006

(30) Foreign Application Priority Data

Dec. 27, 2004 (JP) ..... 2004-378203

(51) Int. Cl.
*F02D 41/30* (2006.01)
*F02D 41/14* (2006.01)

(52) U.S. Cl. ..... 123/674; 123/480

(58) Field of Classification Search ..... 123/672, 123/674, 435–436, 480, 299–300, 305, 486; 701/103–105

See application file for complete search history.

(56) References Cited

U.S. PATENT DOCUMENTS 6,591,817 B2 7/2003 Deutsch
6,739,320 B2 * 5/2004 Ito et al. ..... 123/674
6,810,858 B2 11/2004 Ito et al.
6,856,889 B2 * 2/2005 Nagaishi et al. ..... 701/104
6,990,968 B2 * 1/2006 Nagaishi et al. ..... 123/672
2003/0200952 A1 10/2003 Ito et al.
2003/0200958 A1 10/2003 Ito et al.
2004/0099252 A1 5/2004 Nagaishi et al.
2005/0137779 A1 6/2005 Gioannini et al.

FOREIGN PATENT DOCUMENTS

EP 1 357 280 A2 10/2003
EP 1 361 354 A2 11/2003
JP 2-67442 * 3/1990
JP 9-42077 * 2/1997
JP A 10-103138 4/1998
JP A 10-317936 12/1998
JP 2003-322047 * 11/2003
JP 2006-183570 * 7/2006
JP 2007-32311 * 2/2007

OTHER PUBLICATIONS

U.S. Appl. No. 11/303,949, filed Dec. 19, 2005, Honda et al.

* cited by examiner

*Primary Examiner*—Hai Huynh
(74) *Attorney, Agent, or Firm*—Oliff & Berridge, PLC

(57) ABSTRACT

An air-fuel ratio control apparatus for an internal combustion engine according to the invention includes a control unit that makes a correction to the fuel injection amount using the air-fuel ratio learned value when calculating the fuel injection amount, and that changes the guard value that places a limitation on the degree of correction to the fuel injection amount made by using the air-fuel ratio learned value, based on the degree to which lubricating oil has been diluted with fuel.

24 Claims, 15 Drawing Sheets

AIR-FUEL RATIO CONTROL APPARATUS FOR INTERNAL COMBUSTION ENGINE

INCORPORATION BY REFERENCE

The disclosure of Japanese Patent Application No. 2004-378203 filed on Dec. 27, 2004 including the specification, drawings and abstract is incorporated herein by reference in its entirety.

BACKGROUND OF THE INVENTION

1. Field of the Invention

The invention relates to an air-fuel ratio control apparatus that makes the actual air-fuel ratio substantially equal to the target air-fuel ratio.

2. Description of the Related Art

In internal combustion engines, air-fuel ratio control for making the actual air-fuel ratio substantially equal to the target air-fuel ratio is performed. For example, Japanese Patent Application Publication No. JP-A-10-103138 describes a known internal combustion engine in which air-fuel ratio control is performed.

In the air-fuel ratio control, a feedback correction value that compensates for a temporary deviation of the actual air-fuel ratio from the target air-fuel ratio is calculated through the air-fuel ratio feedback control, and an air-fuel ratio learned value that compensates for a constant deviation of the actual air-fuel ratio from the target air-fuel ratio is calculated through the air-fuel ratio learning control. Then, the final fuel injection amount is calculated in consideration of the feedback correction value and the air-fuel ratio learned value.

In the internal combustion engines, if the fuel injected from an injector is not sufficiently atomized, such fuel which is not sufficiently atomized is mixed into the lubricating oil. As a result, the lubricating oil is diluted with such fuel, namely, "fuel-dilution" occurs. When the fuel is vaporized from the lubricating oil as the temperature of the lubricating oil increases, and is supplied to a combustion chamber again through a blow-by gas reductor, etc., the air-fuel ratio changes due to the influence of such fuel.

If the actual air-fuel ratio becomes constantly richer than the target air-fuel ratio due to the fuel vaporized from the lubricating oil and supplied to the combustion chamber, the air-fuel ratio learned value is updated to a value that decreases the fuel injection amount (i.e., a value that changes the air-fuel ratio to a value leaner than the target air-fuel ratio). Also, as the actual air-fuel ratio becomes richer than the target air-fuel ratio by a larger amount, the fuel injection amount is corrected by a larger amount, using the air-fuel ratio learned value.

When the air-fuel ratio learned value is set to such a value, if the internal combustion engine is started while the temperature thereof is excessively low, the following problem occurs. Although the fuel is not vaporized from the lubricating oil due to the excessively low temperature of the internal combustion engine, the air-fuel ratio learned value is set to a value that decreases the fuel injection amount. As a result, the actual air-fuel ratio becomes excessively lean, causing misfire.

SUMMARY OF THE INVENTION

An air-fuel ratio control apparatus for an internal combustion engine according to a first aspect of the invention includes a control unit that makes a correction to the fuel injection amount using the air-fuel ratio learned value when calculating the fuel injection amount, and that changes the guard value that places a limitation on the degree of correction to the fuel injection amount made by using the air-fuel ratio learned value, based on the degree to which the lubricating oil has been diluted with fuel.

As mentioned above, if the fuel is not vaporized from the lubricating oil, the present air-fuel ratio learned value may deviate significantly from the air-fuel ratio leaned value that is supposed to be set, namely, the air-fuel ratio learned value that corrects the fuel injection amount such that the present air-fuel ratio becomes the target air-fuel ratio (hereinafter, referred to as the "requested learned value"). Even in such a case, the deviation of the present air-fuel ratio from the target air-fuel ratio is decreased by placing a limitation on the present air-fuel ratio learned value, making it possible to suppress occurrence of misfire. However, when the guard value is not appropriately set, even if a limitation is placed on the air-fuel ratio learned value, misfire may eventually occur. Accordingly, the guard value needs to be appropriately set based on the deviation of the present air-fuel ratio learned value from the requested learned value.

In the internal combustion engine, the amount of fuel that is vaporized from the lubricating oil and supplied to the combustion chamber changes based on the degree to which the lubricating oil has been diluted with the fuel. The air-fuel ratio learned value is updated to a value that reflects the amount of fuel that is vaporized from the lubricating oil and supplied to the combustion chamber, namely, the degree to which the lubricating oil has been diluted with the fuel. Accordingly, when the present air-fuel ratio learned value deviates from the requested learned value, the degree of deviation is correlated with the degree to which the lubricating oil has been diluted with the fuel.

According to the first aspect, in consideration of the above-mentioned fact, the guard value for the air-fuel ratio learned value is set, and the guard value is changed based on the degree to which the lubricating oil has been diluted with the fuel. Accordingly, the degree of correction to the fuel injection amount made by using the air-fuel ratio learned value can be appropriately limited. Thus, occurrence of misfire can be suppressed.

An air-fuel ratio control apparatus for an internal combustion engine according to a second aspect of the invention includes a control unit that makes a correction to the fuel injection amount using the air-fuel ratio learned value when calculating the fuel injection amount, and that changes the guard value that places a limitation on the degree of correction to the fuel injection amount made by using the air-fuel ratio learned value, based on the degree to which the fuel has been vaporized from the lubricating oil.

In the internal combustion engine, the amount of fuel that is vaporized from the lubricating oil and supplied to the combustion chamber changes based on the degree to which the fuel has been vaporized from the lubricating oil. The air-fuel ratio learned value is updated to a value that reflects the amount of fuel that is vaporized from the lubricating oil and supplied to the combustion chamber, namely, the degree to which the fuel has been vaporized from the lubricating oil. Accordingly, when the present air-fuel ratio learned value deviates from the requested learned value, the degree of deviation is correlated with the degree to which the fuel has been vaporized from the lubricating oil.

According to the second aspect, in consideration of the above-mentioned fact, the guard value for the air-fuel ratio learned value is set, and the guard value is changed based on the degree to which the fuel has been vaporized from the lubricating oil. Accordingly, the degree of correction to the fuel injection amount made by using the air-fuel ratio learned value can be appropriately limited. Thus, occurrence of misfire can be suppressed.

An air-fuel ratio control apparatus for an internal combustion engine according to a third aspect of the invention includes a control unit that makes a correction to the fuel injection amount using the air-fuel ratio feedback correction value and the air-fuel ratio learned value when calculating the fuel injection amount, and that performs air-fuel ratio feedback control for calculating the air-fuel ratio feedback correction value and air-fuel ratio learning control for calculating the air-fuel ratio learned value. When the air-fuel ratio learning control is not performed, the control unit sets the guard value that places a limitation on the degree of correction to the fuel injection amount made by using the air-fuel ratio learned value, and sets the degree of limitation placed on the air-fuel ratio learned value by the guard value when the air-fuel ratio feedback control is not performed to a value higher than the degree of such limitation when the air-fuel ratio feedback control is performed.

As described above, if the fuel is not vaporized from the lubricating oil, the present air-fuel ratio learned value may deviate significantly from the requested learned value. Even in such a case, the deviation of the present air-fuel ratio from the target air-fuel ratio is decreased by placing a limitation on the present air-fuel ratio learned value, making it possible to suppress occurrence of misfire.

When the present air-fuel ratio learned value deviates significantly from the requested learned value, if the air-fuel ratio feedback control is not performed, the deviation of the present air-fuel ratio from the target air-fuel ratio is not decreased by using the feedback correction value. On the other hand, if the air-fuel ratio feedback control is performed, the deviation of the present air-fuel ratio from the target air-fuel ratio is decreased by using the feedback correction coefficient.

Accordingly, the degree of limitation placed on the air-fuel ratio learned value by the guard value varies depending on whether the air-fuel ratio control is performed. Namely, when the air-fuel ratio feedback control is not performed, because correction to the fuel injection amount using the feedback correction value is not made, the degree of limitation placed on the air-fuel ratio learned value needs to higher than that when the air-fuel ratio feedback control is performed.

According to the third aspect, in consideration of the above-mentioned fact, the guard value for the air-fuel ratio learned value is set, and the guard value is changed based on whether the air-fuel ratio feedback control is performed. Therefore, occurrence of misfire can be suppressed.

An air-fuel ratio control apparatus for an internal combustion engine according to a fourth aspect of the invention includes a control unit that makes a correction to the fuel injection amount using the air-fuel ratio learned value when calculating the fuel injection amount, and that sets the guard value that places a limitation on the degree of correction to the fuel injection amount by using the air-fuel ratio learned value, when detecting that the fuel is not vaporized from the lubricating oil, under the condition that the present air-fuel ratio learned value is a value obtained by updating the air-fuel ratio leaned value while the fuel is vaporized from the lubricating oil.

In the case where the present air-fuel ratio learned value is a value obtained by updating the air-fuel ratio learned value while the fuel is vaporized from the lubricating oil, if the fuel is not vaporized from the lubricating oil, it is estimated that the present air-fuel ratio learned value deviates significantly from the requested learned value.

According to the fourth aspect, in consideration of the above-mentioned fact, the guard value for the air-fuel ratio learned value is set when the above-mentioned condition is satisfied. Accordingly, occurrence of misfire can be suppressed.

BRIEF DESCRIPTION OF THE DRAWINGS

The foregoing and/or further objects, features and advantages of the invention will become more apparent from the following description of exemplary embodiments with reference to the accompanying drawings, in which the same or corresponding portions will be denoted by the same reference numerals and wherein.

DETAILED DESCRIPTION OF THE EXEMPLARY EMBODIMENTS

An embodiment of the invention will be described with reference to FIGS. 1 to 15.

Figure 1:
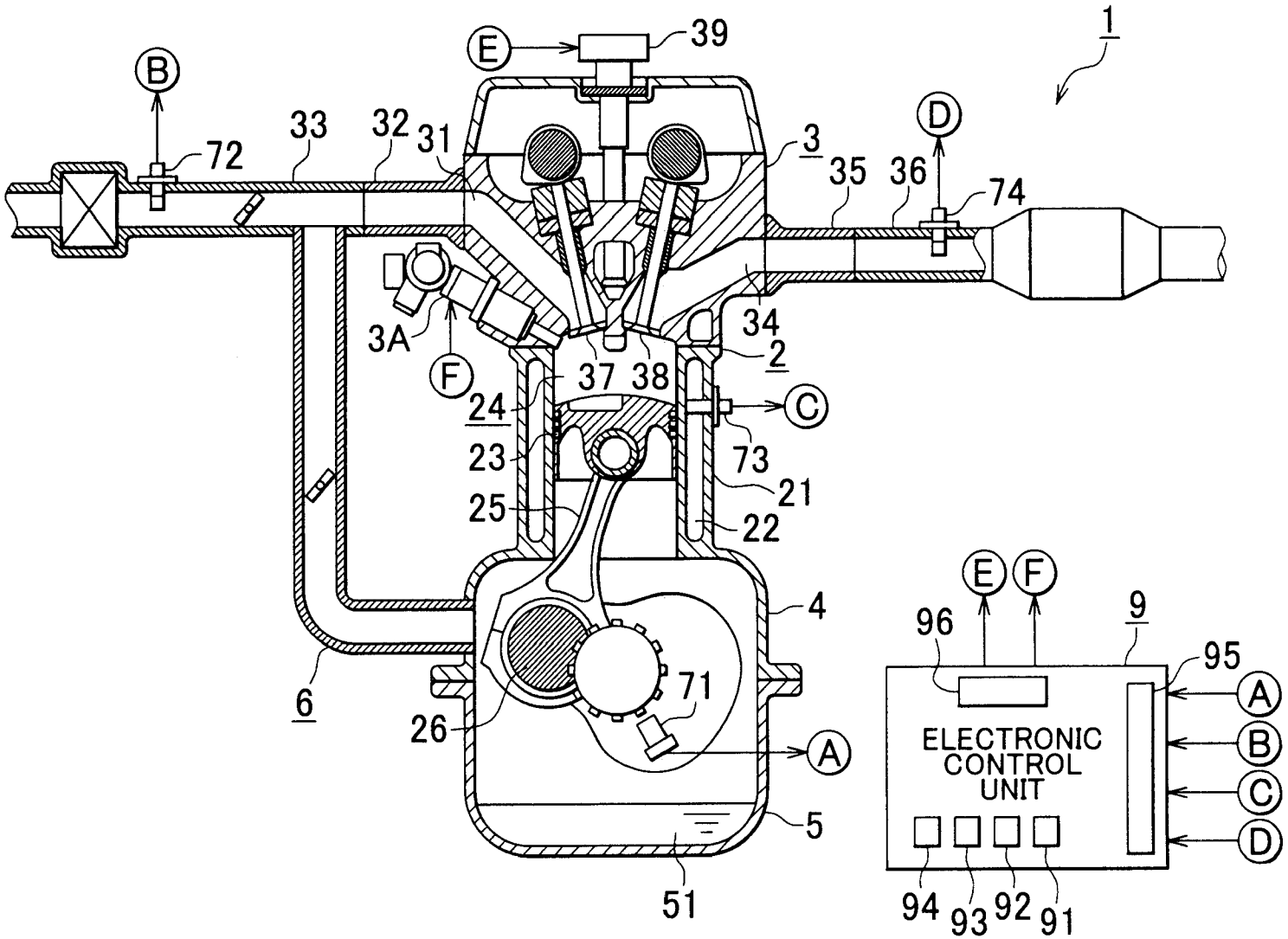
FIG. 1 illustrates the entire configuration of an internal combustion engine to which an air-fuel ratio control apparatus according to an embodiment of the invention is applied.

First, the structure of an engine will be described. FIG. 1 illustrates the structure of the engine (direct injection type internal combustion engine).

An engine 1 includes a cylinder block 2 and a cylinder head 3. The cylinder block 2 is provided with a plurality of cylinders 21. A water jacket 22 is formed in each of the cylinders 21.

A piston 23 is provided in each cylinder 21. A combustion chamber 24 is defined by the inner surface of the cylinder 21, the top surface of the piston 23, and the cylinder head 3.

The piston 23 is coupled with a crankshaft 26 via a connecting rod 25. Below the cylinders 21, a crankcase 4 is provided integrally with the cylinder block 2.

An oil pan 5 is attached to the lower portion of the crankcase 4. The oil pan 5 stores lubricating oil 51 for the engine 1. An intake port 31 and an exhaust port 34 are formed in the cylinder head 3.

An intake manifold 32 is connected to the intake port 31. An intake pipe 33 is connected to the intake manifold 32. The intake pipe 33, the intake manifold 32, and the intake port 31 constitute an intake passage through which air is taken in the combustion chamber 24 from the outside of the engine 1.

An exhaust manifold 35 is connected to the exhaust port 34. An exhaust pipe 36 is connected to the exhaust manifold 35. The exhaust pipe 36, the exhaust manifold 35, and the exhaust port 34 constitute an exhaust passage through which exhaust gas is discharged from the combustion chamber 24 to the outside of the engine 1.

An intake valve 37 opens/closes the intake port 31. An exhaust valve 38 opens/closes the exhaust port 34. An ignition plug 39 ignites the air-fuel mixture present in the combustion chamber 24.

An injector 3A injects fuel directly into the combustion chamber 24. In the engine 1, the gas in the crankcase 4 can be supplied to the intake pipe 33 through a blow-by gas reductor 6.

The engine 1 is controlled by an electronic control unit 9 (hereinafter, simply referred to as an "ECU 9"). A fuel injection control apparatus includes the ECU 9. The ECU 9 includes a central processing unit (hereinafter, simply referred to as a "CPU") 91, read-only memory (hereinafter, simply referred to as "ROM") 92, random-access memory (hereinafter, simply referred to as "RAM") 93, backup memory 94, an input port 95, and an output port 96.

The CPU 91 performs arithmetic processing related to the engine control. The ROM 92 stores programs, maps and the like necessary for the engine control, in advance. The RAM 93 temporarily stores the results of arithmetic processing performed by the CPU 91. The backup memory 94 stores the results of arithmetic processing and the stored data, even after the engine 1 is stopped. The signals from elements outside the ECU 9 are input in the CPU 91 through the input port 95. The signals from the CPU 91 are output to elements outside the ECU 9 through the output port 96.

Various sensors (a rotational speed sensor 71, an intake air amount sensor 72, a coolant temperature sensor 73, and an oxygen sensor 74), which detect the running state of the engine 1, are connected to the input port 95 of the ECU 9.

The rotational speed sensor 71 detects the rotational speed of the crankshaft 26. The data obtained by the rotational speed sensor 71 is input in the ECU 9 as an engine speed NE.

The intake air amount sensor 72 detects the amount of air taken in by the engine 1. The data obtained by the intake air amount sensor 72 is input in the ECU 9 as an intake air amount GA.

The coolant temperature sensor 73 detects the temperature of the coolant in the water jacket 22. The data obtained by the coolant sensor 73 is input in the ECU 9 as a coolant temperature THW.

The oxygen sensor 74 detects the air-fuel ratio of the air-fuel mixture based on the oxygen concentration in the exhaust gas. The output voltage of the oxygen sensor 74 rapidly changes if the air-fuel ratio leaner than the stoichiometric air-fuel ratio is changed to a value richer than the stoichiometric air-fuel ratio or the air-fuel ratio richer than the stoichiometric air-fuel ratio is changed to a value leaner than stoichiometric air-fuel ratio. When the air-fuel ratio is higher than the stoichiometric air-fuel ratio (i.e., when the air-fuel ratio is leaner than the stoichiometric air-fuel ratio), the output voltage of the oxygen sensor 74 is lower than the output voltage corresponding to the stoichiometric air-fuel ratio (reference voltage Vd). On the other hand, when the air-fuel ratio is lower than the stoichiometric air-fuel ratio (i.e., when the air-fuel ratio is richer than the stoichiometric air-fuel ratio), the output voltage of the oxygen sensor 74 is higher than the output voltage corresponding to the stoichiometric air-fuel ratio (reference voltage Vd). The output voltage of the oxygen sensor 74 is input in the ECU 9, as an output voltage Vo.

The output port 96 of the ECU 9 is connected to the ignition plug 39, the injector 3A, and the like. The ECU 9 controls, for example, the ignition timing of the ignition plug 39, the amount of fuel injected from the injector 3A, and the air-fuel ratio of the air-fuel mixture, based on the data obtained by the above-mentioned sensors.

Next, dilution of lubricating oil with fuel will be described in detail. In the engine 1, if the fuel injected from the injector 3A is not sufficiently atomized (mainly when the engine 1 is cold), a large amount of the injected fuel adheres to the inner surface of the cylinder 21, and is mixed with the lubricating oil 51. As a result, the lubricating oil 51 is diluted with the fuel. The lubricating oil 51 containing the fuel adhering to the inner surface of the cylinder 21 will drop into the oil pan 5 due to reciprocation of the piston 23. Even in the engine in which fuel is injected toward the intake port, if the temperature of the engine is excessively low, the lubricating oil 51 is diluted with the fuel.

When the fuel mixed in the lubricating oil 51 in the oil pan 5 vaporizes as the temperature of the lubricating oil 51 increases, the vaporized fuel is supplied to the intake pipe 33 through the blow-by gas reductor 6. Accordingly, in the engine 1, the final fuel injection amount is set in consideration of the amount of fuel supplied from the crankcase 4 to the intake pipe 33.

Figure 2:
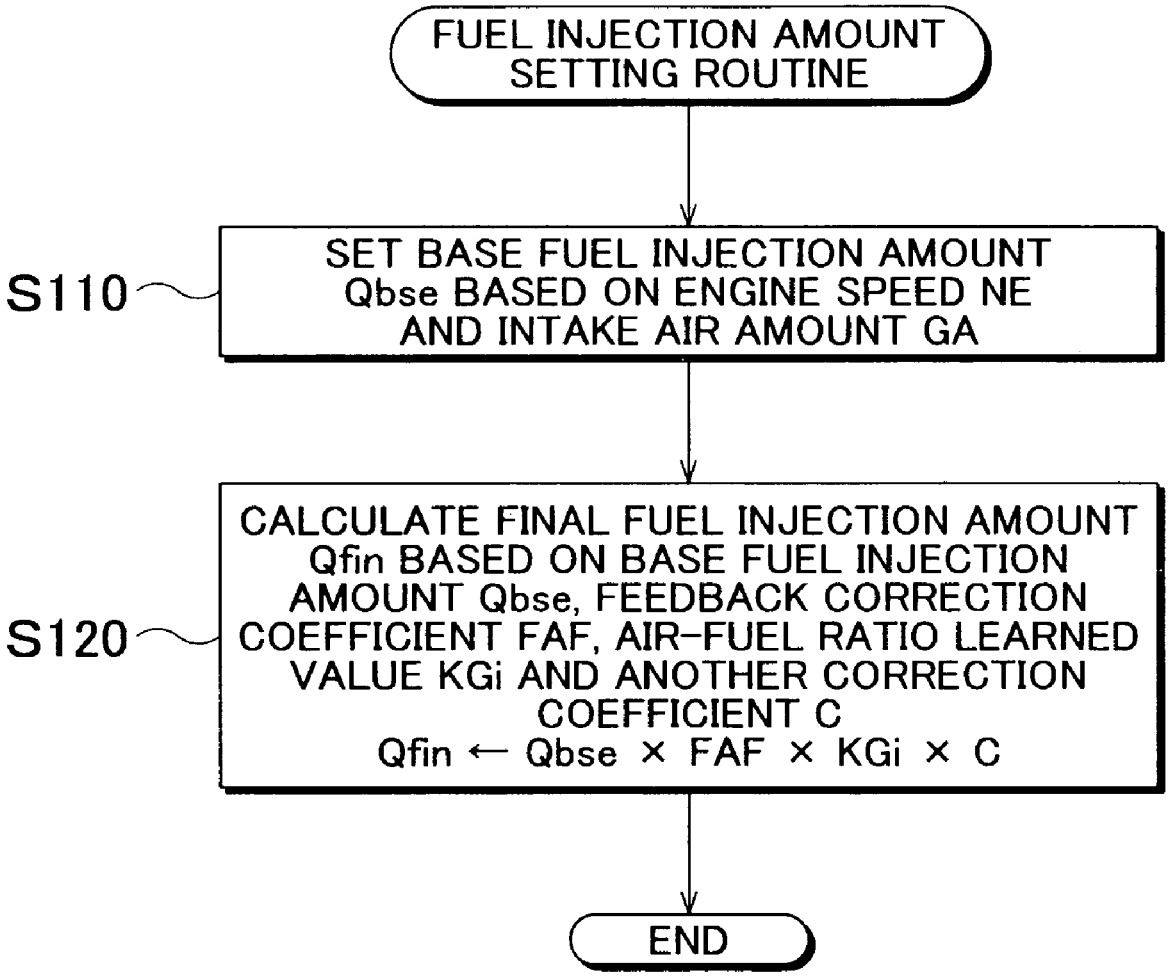
FIG. 2 illustrates the flowchart showing the steps of the "fuel injection amount setting routine" used for the internal combustion engine according to the embodiment, which is performed by an electronic control unit.

The "fuel injection amount setting routine" will be described with reference to FIG. 2. The ECU 9 repeatedly performs the fuel injection amount setting routine at predetermined time intervals.

In step S110, the ECU 9 sets a base value of the fuel injection amount (hereinafter, referred to as a "base fuel injection amount Qbse") based on the engine speed NE and the intake air amount GA.

In step S120, the ECU 9 sets a command value of the fuel injection amount (hereinafter, referred to as a "final fuel injection amount Qfin") for the injector 3A, based on the base fuel injection amount Qbse, a feedback correction coefficient FAF, an air-fuel ratio learned value KGi, and another correction coefficient C. Namely, the ECU 9 calculates the final fuel injection amount Qfin according to the following equation (1)

$$Qfin \leftarrow Bbse \times FAF \times KGi \times C \quad (1)$$

The feedback correction coefficient FAF is calculated as the value that compensates for the temporary deviation of the actual air-fuel ratio from the target air-fuel ratio (stoichiometric air-fuel ratio).

The air-fuel ratio learned value KGi is calculated as the value that compensates for the constant deviation of the actual air-fuel ratio from the stoichiometric air-fuel ratio. The air-fuel ratio learned value KGi is updated for each of a plurality of learning regions "i" that are set based on the load of the engine 1 (intake air amount GA). The character "i" in the air-fuel ratio learned value KGi indicates the correlation with the learning region "i". When the load of the engine 1 is in the learning region "x" and the final fuel injection amount Qfin is calculated, an air-fuel ratio learned value KGx corresponding to the learning region "x" is selected.

In the embodiment, the air-fuel ratio learned value KGi corresponding to the learning region "i" on the lowest load side from among the plurality of learning regions "i" that are set based on the engine load is a low load learned value KGL. The air-fuel ratio learned value KGi corresponding to the learned value "i" on the highest load side is a high load learned value KGH.

Hereafter, the air-fuel ratio control will be described in detail. In the engine 1, the air-fuel ratio control for making the actual air-fuel ratio substantially equal to the stoichiometric air-fuel ratio is performed. The air-fuel ratio control includes the air-fuel ratio feedback control for calculating the feedback correction coefficient FAF and the air-fuel ratio learning control for calculating the air-fuel ratio learned value KGi. The air-fuel ratio feedback control is performed through the "feedback correction coefficient calculating routine" that will be described later in detail. The air-fuel ratio learning control is performed through the "air-fuel ratio learned value calculating routine" that will be described later in detail.

Figure 3:
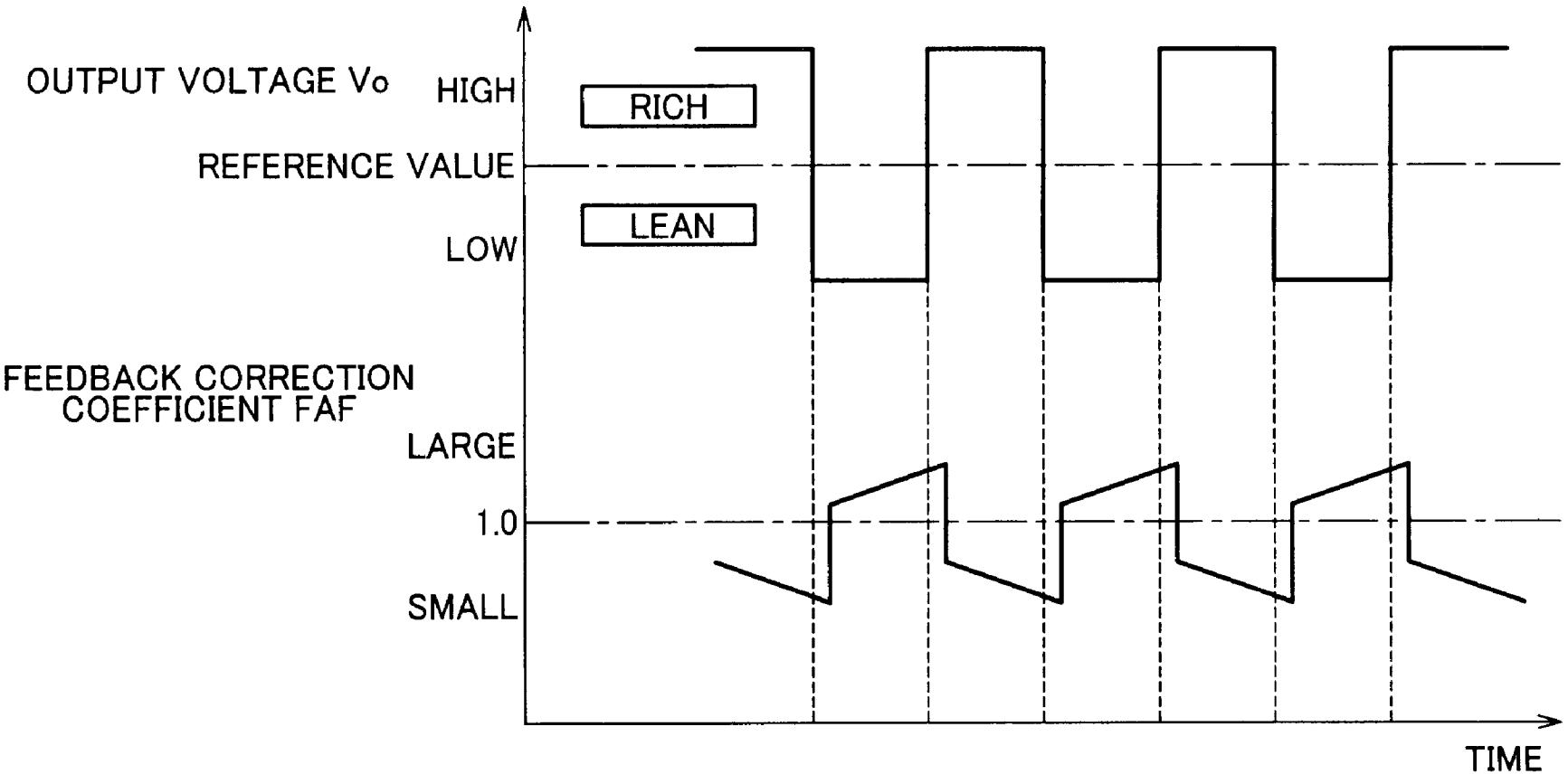
FIG. 3 illustrates the time-chart used for the internal combustion engine according to the embodiment, which shows an example of how the output voltage of an oxygen sensor and the feedback correction coefficient change with time.
Figure 4:
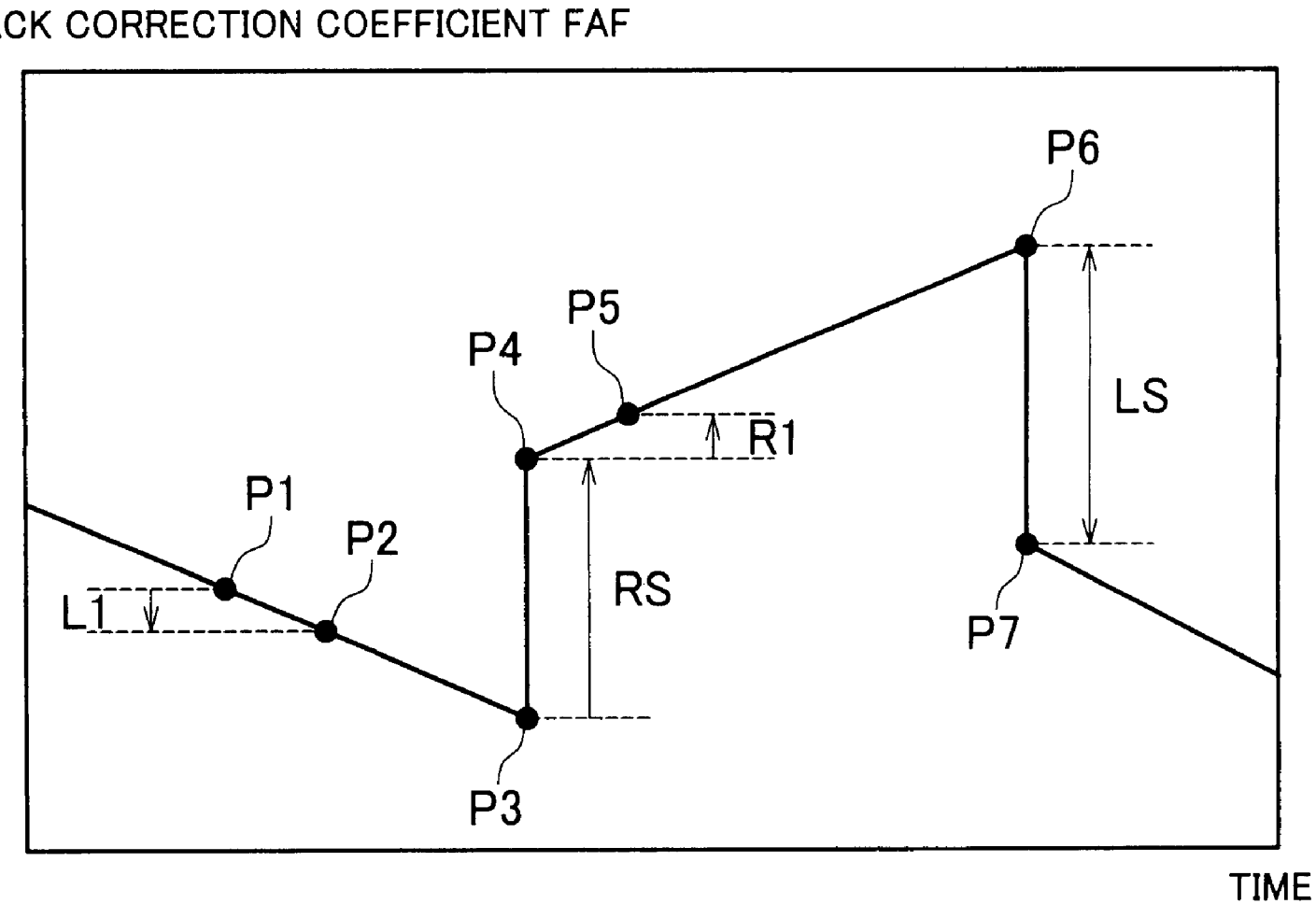
FIG. 4 illustrates the time-chart used for the internal combustion engine according to the embodiment, which shows an example of how the feedback correction coefficient changes with time in the air-fuel ratio feedback control.

Hereafter, the outline of the air-fuel ratio feedback control will be described in detail. With reference to FIGS. 3 and 4, calculation of the feedback correction coefficient FAF in the air-fuel ratio feedback control will be described.

FIG. 3 illustrates an example of how the output voltage Vo of the oxygen sensor 74 and the feedback correction coefficient FAF change with time. FIG. 4 illustrates an example of how the feedback correction coefficient FAF changes with time.

When the output voltage Vo is continuously higher than the reference voltage Vd, an integral amount LI is subtracted from the feedback correction coefficient FAF. Namely, if the feedback correction coefficient FAF is at a point P1 and the integral amount LI is subtracted from the feedback correction coefficient FAF, the feedback correction coefficient FAF moves to a point P2. The feedback correction coefficient FAF is gradually decreased through the control for continuously subtracting the integral amount LI from the feedback correction coefficient FAF at predetermined time intervals (i.e., so-called integral control). When the integral control is performed, the feedback correction coefficient FAF decreases more rapidly as the integral amount LI increases, and decreases more gradually as the integral amount LI decreases.

If the above-mentioned control for gradually decreasing the feedback correction coefficient FAF is continuously performed, the air-fuel ratio changes from a value richer than the stoichiometric air-fuel ratio to a value leaner than the stoichiometric air-fuel ratio, and the output voltage Vo changes from a value higher than the reference voltage Vd to a value lower than the reference voltage Vd.

When the output voltage Vo changes from a value higher than the reference voltage Vd to a value lower than the reference voltage Vd, a skip amount RS is added to the feedback correction coefficient FAF. Namely, if the feedback correction coefficient FAF is at a point P3 and the skip amount RS is added to the feedback correction coefficient FAF, the feedback correction coefficient FAF changes to a point P4. Through the control for adding the skip amount RS to the feedback correction coefficient FAF (i.e., so-called skip control), the feedback correction coefficient FAF changes by a larger amount than when the integral control is performed.

The skip amount RS is set to a value at which the air-fuel ratio does not changes suddenly from a value leaner than stoichiometric air-fuel ratio to a value richer than the stoichiometric air-fuel ratio. Accordingly, even after the skip amount RS is added to the feedback correction coefficient FAF, the air-fuel ratio is continuously leaner than the stoichiometric air-fuel ratio, and the output voltage Vo is continuously lower than the reference voltage Vd.

When the output voltage Vo is continuously lower than the reference voltage Vd, an integral amount RI is added to the feedback correction coefficient FAF. Namely, if the feedback correction coefficient FAF is at the point P4 and the integral amount RI is added to the feedback correction coefficient FAF, the feedback correction coefficient FAF changes to a point P5. Through the integral control for continuously adding the integral amount RI to the feedback correction coefficient FAF at predetermined time intervals, the feedback correction coefficient FAF gradually increases. When the integral control is performed, the feedback correction coefficient FAF increases more rapidly as the integral amount RI increases, and the feedback correction coefficient FAF increases more gradually as the integral amount RI decreases.

If the above-mentioned control for gradually increasing the feedback correction coefficient FAF is continuously performed, the air-fuel ratio changes from a value leaner than the stoichiometric air-fuel ratio to a value richer than the stoichiometric air-fuel ratio. In accordance with this, the output voltage Vo changes from a value lower than the reference voltage Vd to a value higher than the reference voltage Vd.

When the output voltage Vo changes from a value lower than the reference voltage Vd to a value higher than the reference voltage Vd, a skip amount LS is subtracted from the feedback correction coefficient FAF. If the feedback correction coefficient FAF is at a point P6 and the skip amount LS is subtracted from the feedback correction coefficient FAF, the feedback correction coefficient changes to a point P7. Through the skip control for subtracting the skip amount LS from the feedback correction coefficient FAF, the feedback correction coefficient FAF changes by a larger amount than when the integral control is performed.

The skip amount LS is set to a value at which the air-fuel ratio does not changes suddenly from a value richer than the stoichiometric air-fuel ratio to a value leaner than the stoichiometric air-fuel ratio. Accordingly, even after the skip amount LS is subtracted from the feedback correction coefficient FAF, the air-fuel ratio is continuously richer than the stoichiometirc air-fuel ratio, and the output voltage Vo is continuously higher than the reference voltage Vd.

Figure 5:
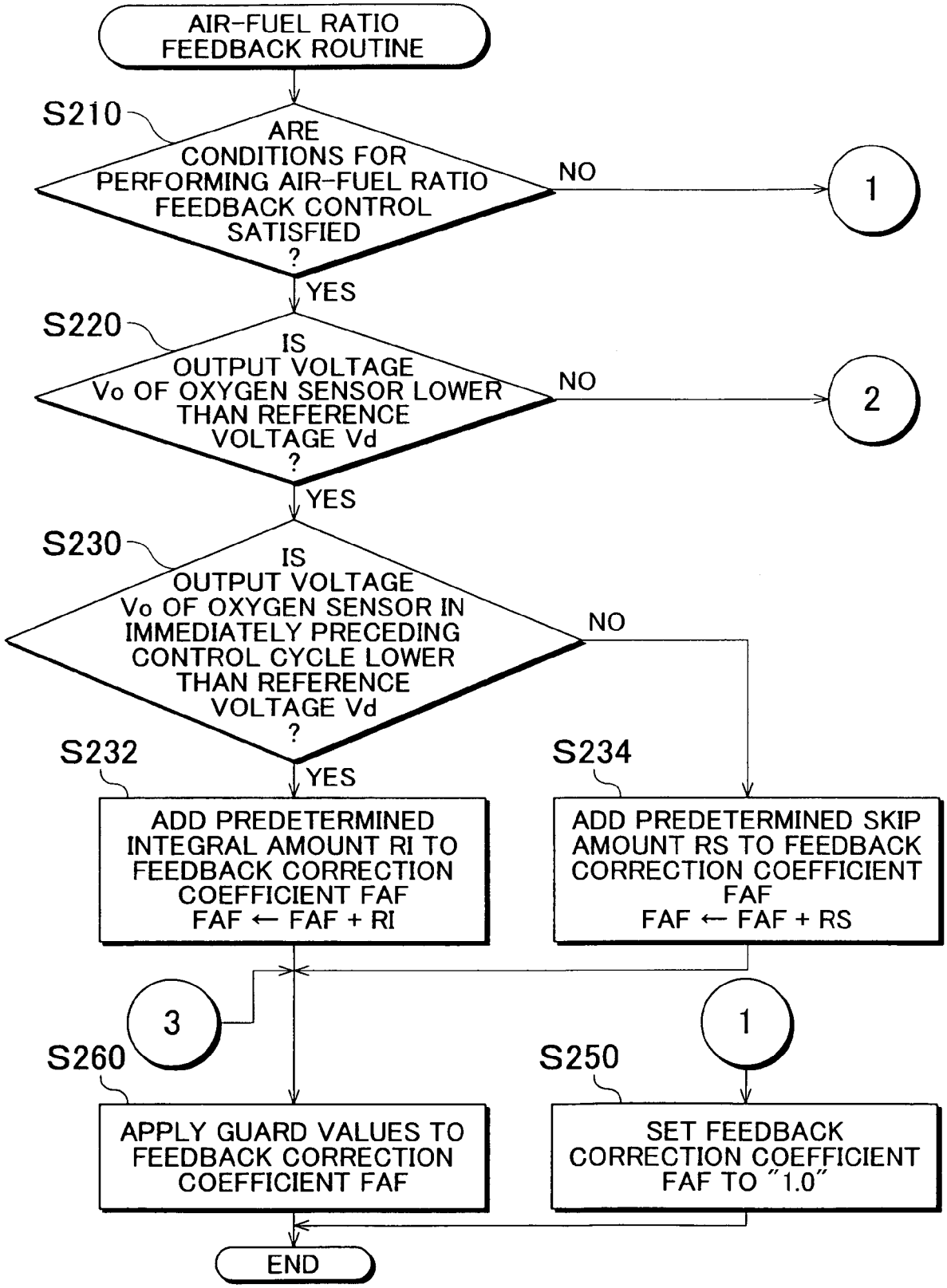
FIG. 5 illustrates the flowchart showing a part of the "air-fuel ratio feedback routine" used for the internal combustion engine according to the embodiment, which is performed by the electronic control unit.
Figure 6:
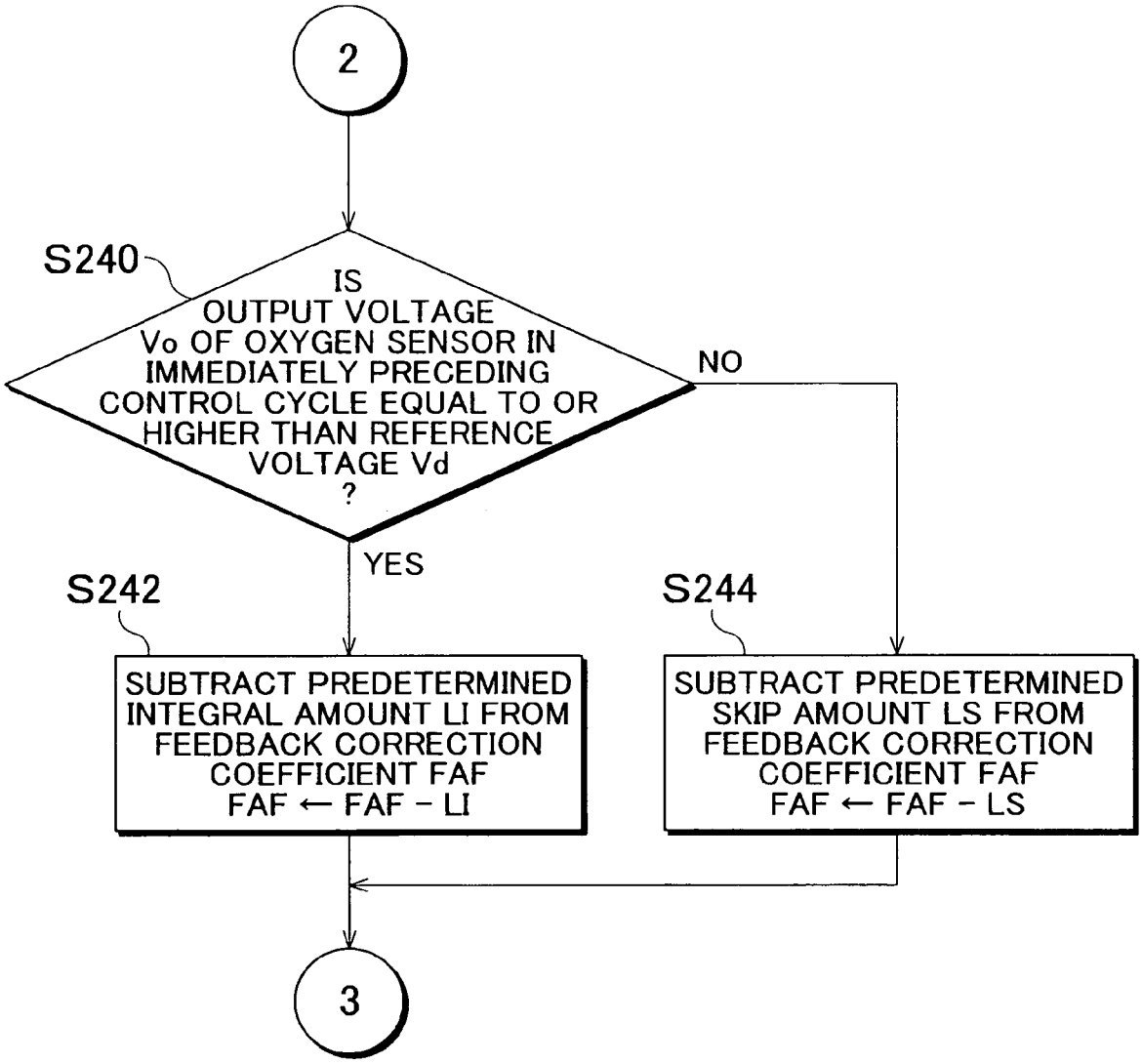
FIG. 6 illustrates the flowchart showing a part of the "air-fuel ratio feedback routine" used for the internal combustion engine according to the embodiment, which is performed by the electronic control unit.

Hereafter, the air-fuel ratio feedback routine will be described with reference to FIGS. 5 and 6. The ECU 9 performs the air-fuel ratio feedback routine at predetermined time intervals.

In step S210, the ECU 9 determines whether the conditions for performing the air-fuel ratio feedback control are satisfied. In the embodiment, the ECU 9 determines whether the following conditions are satisfied.

(a) The engine is running, excluding the period of time when the engine is started.

(b) Fuel cut is not being performed.

(c) The oxygen sensor 74 is activated.

The ECU 9 determines the state of the engine 1 as follows based on the determination made in step S210.

If all the above conditions (a) to (c) are satisfied, the ECU 9 determines that the engine 1 is in the state where the air-fuel ratio feedback control can be appropriately performed. When such a determination is made, the ECU 9 performs step S220.

On the other hand, if at least one of the above conditions (a) to (c) is not satisfied, the ECU 9 determines that the engine 1 is in the state where the air-fuel ratio feedback control cannot be appropriately performed. When such a determination is made, the ECU performs step S250.

In step S220, the ECU 9 determines whether the output voltage Vo of the oxygen sensor 74 is lower than the reference voltage Vd. The ECU 9 then determines whether the actual air-fuel ratio is leaner than the stoichiometric air-fuel ratio based on the determination made in step S220.

If the output voltage Vo is lower than the reference voltage Vd, the ECU 9 determines that the actual air-fuel ratio is leaner than the stoichiometric air-fuel ratio. When such a determination is made, the ECU 9 performs step S230.

On the other hand, if the output voltage Vo is equal to or higher than the reference voltage Vd, the ECU 9 determines that the actual air-fuel ratio is richer than the stoichiometric air-fuel ratio. When such a determination is made, the ECU 9 performs step S240.

In step S230, the ECU 9 determines whether the output voltage Vo of the oxygen sensor 74 in the immediately preceding control cycle is lower than the reference voltage Vd. The ECU 9 then determines whether the air-fuel ratio is continuously leaner than the stoichiometric air-fuel ratio based on the determination made in step S230.

If the output voltage Vo in the immediately preceding control cycle is lower than the reference voltage Vd, the ECU 9 determines that the actual air-fuel ratio is continuously leaner than the stoichiometric air-fuel ratio. When such a determination is made, the ECU 9 performs step S232.

On the other hand, if the output voltage Vo in the immediately preceding control cycle is equal to or higher than the reference voltage Vd, the ECU 9 determines that the actual air-fuel ratio changes from a value richer than the stoichiometric air-fuel ratio to a value leaner than the air-fuel ratio. When such a determination is made, the ECU 9 performs step S234.

In step S232, the feedback correction coefficient FAF is set to a new value obtained by adding the predetermined integral amount RI (RI>0) to the feedback correction coefficient FAF. Namely, the ECU 9 calculates the new feedback correction coefficient FAF according to the following equation (2).

$$FAF \leftarrow FAF + RI \tag{2}$$

In step S234, the feedback correction coefficient FAF is set to a new value obtained by adding the predetermined skip amount RS (RS>0) to the feedback correction coefficient FAF. Namely, the ECU 9 calculates the new feedback correction coefficient FAF according to the following equation (3). The skip amount RS is set to a value that is sufficiently greater than the integral amount RI.

$$FAF \leftarrow FAF + RS \tag{3}$$

In step S240, the ECU 9 determines whether the output voltage Vo of the oxygen sensor 74 in the immediately preceding control cycle is equal to or higher than the reference voltage Vd. The ECU 9 then determines whether the actual air-fuel ratio is continuously richer than the stoichiometric air-fuel ratio based on the determination made in step S240.

If the output voltage Vo in the immediately preceding control cycle is equal to or higher than the reference voltage Vd, the ECU 9 determines that the actual air-fuel ratio is continuously richer than the stoichiometric air-fuel ratio. When such a determination is made, the ECU 9 performs step S242.

On the other hand, if the output voltage Vo in the immediately preceding control cycle is lower than the reference voltage Vd, the ECU 9 determines that the actual air-fuel ratio is changed from a value leaner than the stoichiometric air-fuel ratio to a value richer than the stoichiometric air-fuel ratio. When such a determination is made, the ECU 9 performs step S244.

In step S242, the feedback correction coefficient FAF is set to a new value obtained by subtracting the predetermined integral amount LI (LI>0) from the feedback correction coefficient FAF. Namely, the ECU 9 calculates the new feedback correction coefficient FAF according to the following equation (4).

$$FAF \leftarrow FAF - LI \tag{4}$$

In step S244, the feedback correction coefficient FAF is set to a new value obtained by subtracting the predetermined skip amount LS (LS>0) from the feedback correction coefficient FAF. Namely, the ECU 9 calculates the new feedback correction coefficient FAF according to the following equation (5). The skip amount LS is set to a value that is sufficiently greater than the integral value LI.

$$FAF \leftarrow FAF - LS \tag{5}$$

In step S250, the feedback correction coefficient FAF is set to "1.0". In this case, correction to the base fuel injection amount Qbse based on the feedback correction coefficient FAF is not actually made.

In step S260, guard values (an upper limit guard value GFAFU and a lower limit guard value GFAFL) are applied to the feedback correction coefficient FAF. The guard value is set through another process. After step S260 or step S250 is performed, the ECU 9 ends the routine.

The feedback correction coefficient FAF is limited by the guard values.

The upper limit of the feedback correction coefficient FAF is limited by the upper limit guard value GFAFU. Namely, when the feedback correction coefficient FAF is set to a value equal to or greater than the upper limit guard value GFAFU, the feedback correction coefficient FAF is set to a value equal to the upper limit guard value GFAFU, and then the final fuel injection amount Qfin is calculated.

The lower limit of the feedback correction coefficient FAF is limited by the lower limit guard value GFAFL. Namely, when the feedback correction coefficient FAF is set to a value equal to or less than the lower limit guard value GFAFL, the feedback correction coefficient FAF is set to a value equal to the lower limit guard value GFAFL, and then the final fuel injection amount Qfin is calculated.

Hereafter, the outline of the air-fuel ratio learning control will be described. When the actual air-fuel ratio does not tend to constantly deviate from the stoichiometric air-fuel ratio, the feedback correction coefficient FAF changes in a range whose center value is the reference value "1.0". Accordingly, the average value of the feedback correction coefficient FAF is approximately "1.0".

On the other hand, when the actual air-fuel ratio tends to become constantly richer or leaner than the stoichiometric air-fuel ratio due to, for example, the individual difference of the injection characteristics in the injector 3A and vaporization of the fuel from the lubricating oil, the feedback correction coefficient FAF changes in the range whose center value is different from the reference value "1.0". Accordingly, the average value of the feedback correction coefficient FAF becomes substantially equal to a value that is different from "1.0" based on the deviation from the stoichiometric air-fuel ratio.

In the air-fuel ratio learning control, the feedback correction coefficient FAF is prevented from excessively deviating from "1.0", by correcting the fuel injection amount using the air-fuel ratio learned value KGi. Thus, the accuracy of the air-fuel ratio feedback control is improved.

The air-fuel ratio learned value KGi increases as the feedback correction coefficient FAF increases. Accordingly, the feedback correction coefficient FAF approaches or falls within the predetermined range including "1.0", by correcting the fuel injection amount using the air-fuel ratio learned value KGi. The air-fuel ratio learned value KGi is obtained through the air-fuel ratio learning control. When the amount of fuel vaporized from the lubricating oil increases with the increase in the degree to which the lubricating oil has been diluted with fuel, the actual air-fuel ratio tends to deviate from the stoichiometric air-fuel ratio. Such tendency is reflected on the air-fuel ratio learned value KGi.

Figure 7:
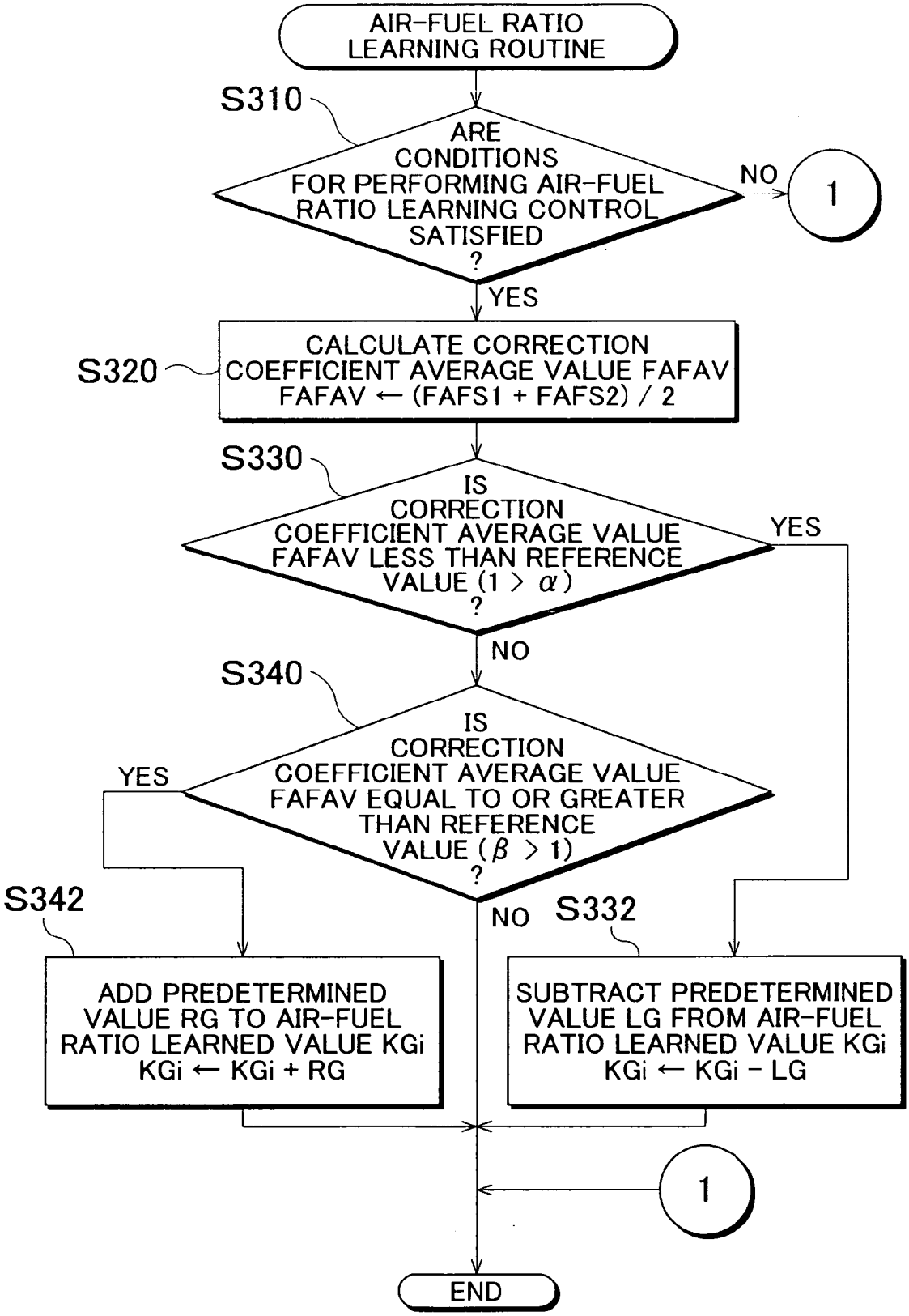
FIG. 7 illustrates the flowchart showing the steps of the "air-fuel ratio learning routine" used for the internal combustion engine according to the embodiment, which is performed by the electronic control unit.
Figure 8:
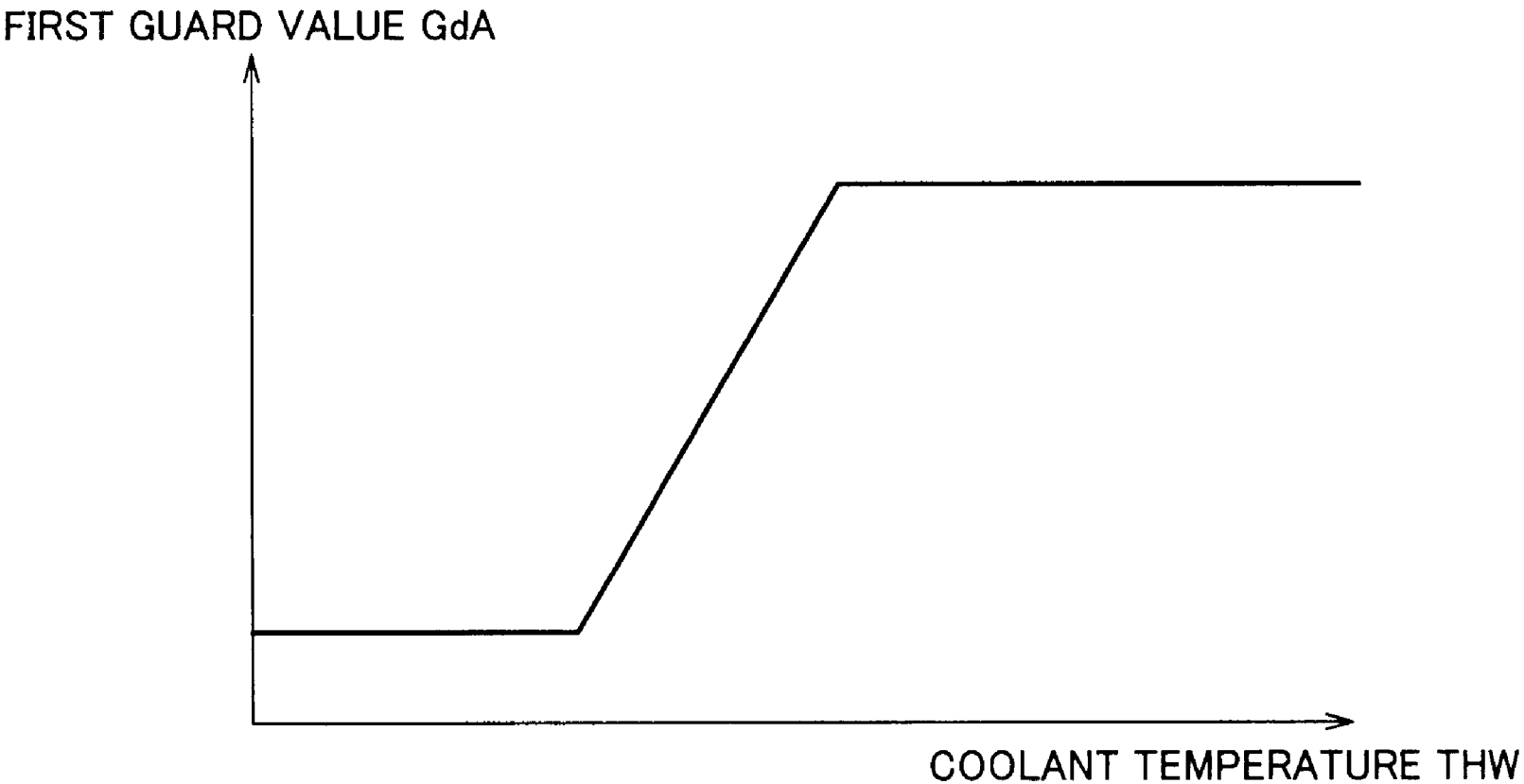
FIG. 8 illustrates an example of the first guard value calculation map used in the "learned value guard routine" according to the embodiment.
Figure 9:
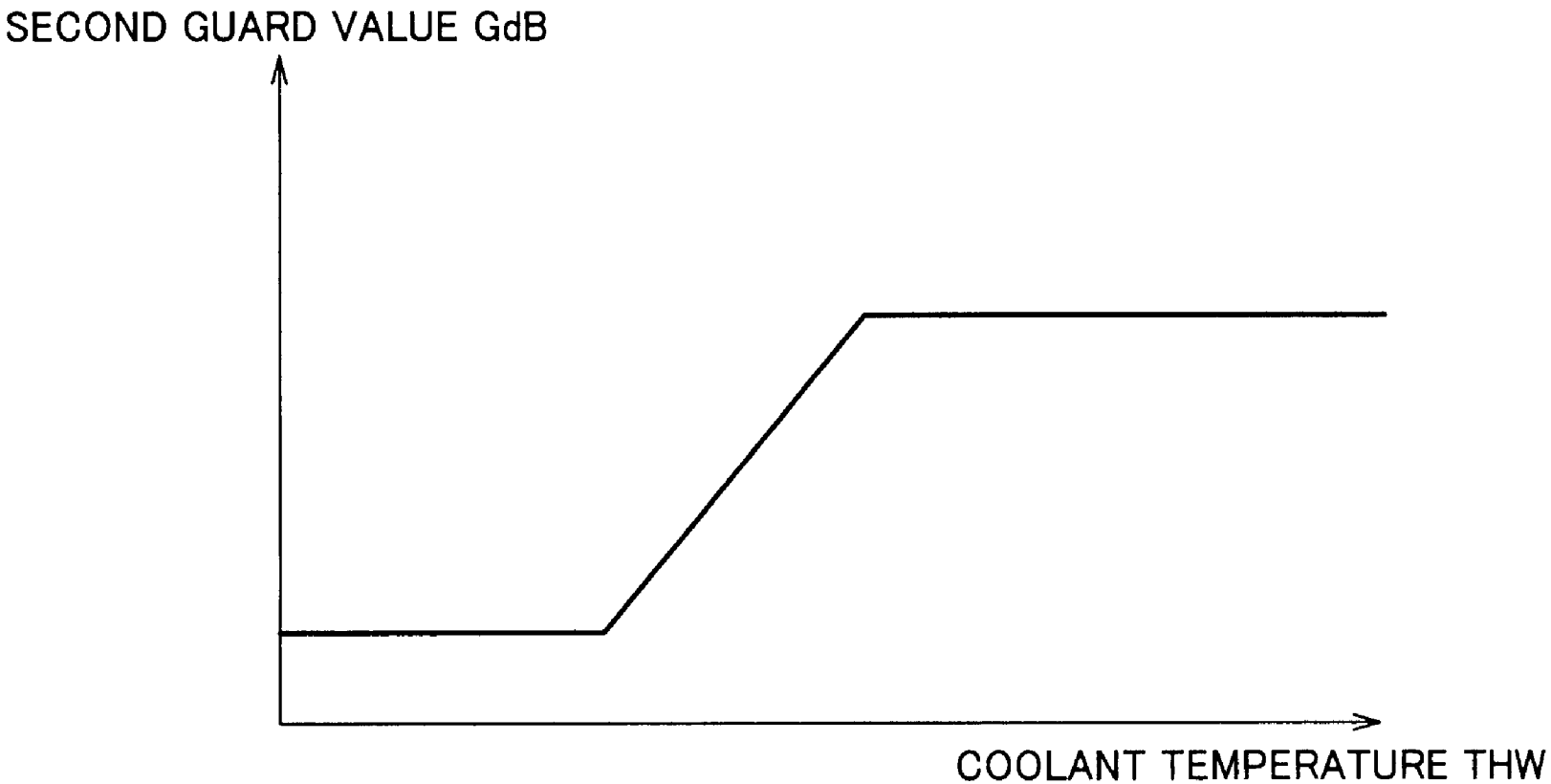
FIG. 9 illustrates an example of the second guard value calculation map used in the "learned value guard routine" according to the embodiment.
Figure 10:
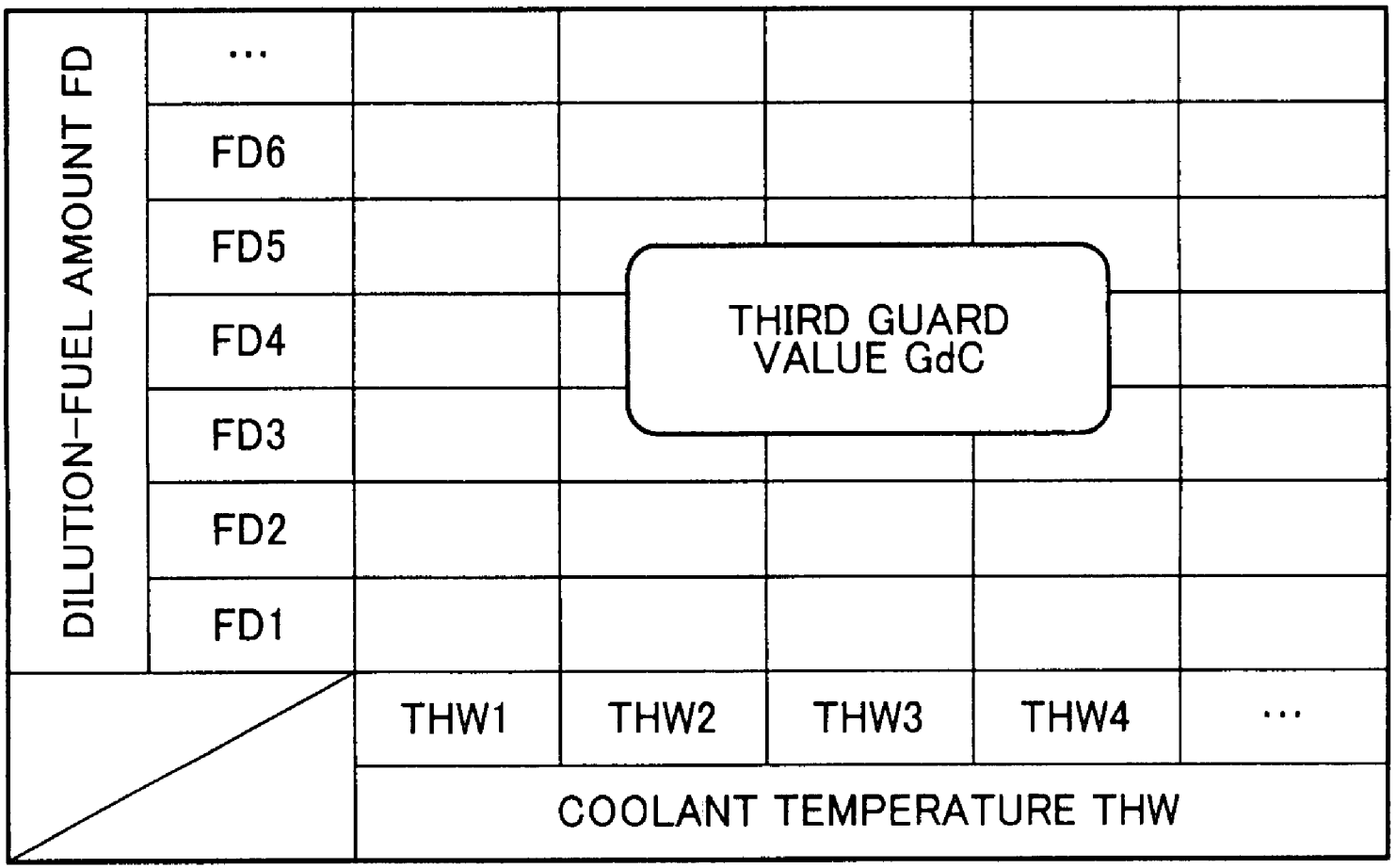
FIG. 10 illustrates an example of the third guard value calculation map used in the "learned value guard routine" according to the embodiment.

Next, with reference to FIG. 7 the "air-fuel ratio learning routine" will be described in detail. The ECU 9 repeatedly performs the air-fuel ratio learning routine at predetermined time intervals.

In step S310, the ECU 9 determines whether the condition for performing the air-fuel ratio learning control is satisfied. In this case, the ECU 9 determines whether the following conditions are satisfied.

(a) The coolant temperature THW is equal to or higher than the temperature of the coolant that is obtained when warm-up of the engine is completed (hereinafter, referred to as a "warm-up time coolant temperature THWH").

(b) The air-fuel ratio feedback control is performed.

The ECU 9 determines whether the engine 1 is in the state where the air-fuel ratio learning control can be appropriately performed, based on the determination made in step S310.

If both the above conditions (a) and (b) are satisfied, the ECU 9 determines that the engine 1 is in the state where the air-fuel ratio learning control can be appropriately performed. When such a determination is made, the ECU 9 performs step S320.

On the other hand, if at least one of the above-mentioned conditions (a) and (b) is not satisfied, the ECU 9 determines that the engine 1 is in the state where the air-fuel ratio learning control cannot be appropriately performed. When such a determination is made, the ECU 9 ends the routine.

In step S320, the ECU 9 calculates the average value of the feedback correction coefficient FAF when the output voltage Vo of the oxygen sensor 74 changes from a value lower than the reference voltage Vd to a value higher than the reference voltage Vd or from a value higher than the reference voltage Vt to a value lower than the reference voltage Vd, that is, when the skip control is performed. That is, the ECU 9 calculates the average value (correction coefficient average value FAFAV) of the feedback correction coefficient FAF in the immediately preceding skip control (skip time correction coefficient FAFS1) and the feedback correction coefficient FAF in the second preceding skip control performed (skip time correction coefficient FAFS2). Namely, the ECU 9 calculates the correction coefficient average value FAFAV according to the following equation (6).

$$FAFAV \leftarrow (FAFS1+FAFS2)/2 \quad (6)$$

In step S330, the ECU 9 determines whether the correction coefficient average value FAFAV is less than a reference value α. The reference value α is set to a value less than "1.0". The ECU 9 then determines whether the actual air-fuel ratio tends to be richer than the stoichiometric air-fuel ratio based on the determination made in step S330.

If the correction coefficient average value FAFAV is less than the reference value α, the ECU 9 determines that the actual air-fuel ratio tends to be richer than the stoiochiometric air-fuel ratio. When such a determination is made, the ECU 9 performs step S332.

On the other hand, if the correction coefficient average value FAFAV is equal to or greater than the reference value α, the ECU 9 determine that the actual air-fuel ratio does not tend to be richer than the stoichiometric air-fuel ratio. When such a determination is made, the ECU 9 performs step S340.

In step S332, The ECU 9 updates the air-fuel ratio learned value KGi to a smaller value to compensate for the tendency of the actual air-fuel ratio to become richer than the stoichiometric air-fuel ratio. Here, the air-fuel ratio learned value KGi is set to a new value (KGi−LG) obtained by subtracting a predetermined value LG from the air-fuel ratio learned value KGi corresponding to the present learning region "i". Namely, the ECU 9 calculates the new air-fuel ratio learned value KGi according to the following equation (7).

$$KGi \leftarrow KGi-LG \quad (7)$$

In step S340, the ECU 9 determines whether the correction coefficient average value FAFAV is equal to or greater than a reference value β. The reference value β is set to a value greater than "1.0". The ECU 9 then determines whether the actual air-fuel ratio tends to be leaner than the stoichiometric air-fuel ratio based on the determination made in step S340.

If the correction coefficient average value FAFAV is equal to or greater than the reference value β, the ECU 9 determines that the actual air-fuel ratio tends to be leaner than the stoichiometric air-fuel ratio. When such a determination is made, the ECU 9 performs step S342.

On the other hand, if the correction coefficient average value FAFAV is less than the reference value β, the ECU 9 determines that the actual air-fuel ratio does not tend to be leaner than the stoichiometric air-fuel ratio. Namely, when the correction coefficient average value FAFAV is less than the reference value β and greater than the reference value α, the correction coefficient average value FAFAV changes in the range whose center value is the reference value "1.0". Accordingly, the ECU 9 determines that the actual air-fuel ratio does not tend to deviate from the stoichiometric air-fuel ratio. When such a determination is made, the ECU 9 ends the routine without updating the air-fuel ratio learned value KGi.

In step S342, the ECU 9 updates the air-fuel ratio learned value KGi to a greater value to compensate for the tendency of the actual air-fuel ratio to become leaner than the stoichiometric air-fuel ratio. In this case, the air-fuel ratio learned value KGi is set to a new value (KGi+RG) obtained by adding a predetermined value RG to the air-fuel ratio learned value KGi corresponding to the present learning region "i". Namely, the ECU 9 calculates the new air-fuel ratio learned value KGi according to the following equation (8).

$$KGi \leftarrow KGi + RG \tag{8}$$

Next, misfire due to the fuel-dilution will be described in detail. If the fuel is vaporized from the lubricating oil while the engine 1 is running, the actual air-fuel ratio tends to be constantly richer than the stoichiometric air-fuel ratio. Therefore, the air-fuel ratio learned value KGi is updated to a value that decreases the base fuel injection amount Qbse (i.e., a value that changes the actual air-fuel ratio from a value richer than the stoichiometric air-fuel ratio to a value leaner than the stoichiometric air-fuel ratio) to compensate such deviation from the stoichiometric air-fuel ratio. After this, if the engine 1 is stopped and then started again while the temperature thereof is excessively low, the following problem will arise.

Although the actual air-fuel ratio is not influenced by the fuel mixed in the lubricating oil because the fuel is not vaporized from the lubricating oil, the final fuel injection amount Qfin is set to a value smaller than the requested fuel injection amount by correcting the base fuel injection amount Qbse using the air-fuel ratio learned value KGi that is set in the above-mentioned manner.

At this time, if the degree of influence of the fuel mixed in the lubricating oil on the present air-fuel ratio learned value KGi is low, namely, if the amount of fuel vaporized from the lubricating oil is small when the air-fuel ratio learned value KGi is updated, the deviation of the actual air-fuel ratio from the stoichiometric air-fuel ratio is small. On the other hand, if the amount of fuel vaporized from the lubricating oil is large when the air-fuel ratio learned value KGi is updated, the final fuel injection amount Qfin becomes a value significantly less than the requested fuel injection amount. As a result, misfire will occur because the actual air-fuel ratio becomes excessively lean. In the embodiment, therefore, the "learned value guard routine", described below in detail, is performed to suppress occurrence of such misfire.

Hereafter, the learned value guard routine will be described in detail. When the present air-fuel ratio learned value KGi significantly deviates from the air-fuel ratio learned value that is supposed to be set because the fuel is vaporized from the lubricating oil (or even if the fuel is vaporized from the lubricating oil, the amount of vaporized fuel is considerably small), the deviation of the actual air-fuel ratio from the stoichiometric air-fuel ratio is made smaller by limiting the air-fuel ratio learned value KGi to suppress occurrence of misfire. The requested learned value corresponds to the air-fuel ratio learned value corresponding to the state where the fuel is not vaporized from the lubricating oil.

In the state estimated as described above, if the air-fuel ratio learned value KGi becomes a value excessively less than the requested learned value, misfire occurs. Therefore, a lower limit guard value GL for the air-fuel ratio learned value KGi needs to be set to an appropriate value.

The requested lower limit guard value GL significantly varies based on whether the following conditions (i) to (ii) are satisfied, on the assumption that the air-fuel ratio learned value KGi deviates significantly from the requested learned value because the fuel is not vaporized from the lubricating oil.

(i) The air-fuel ratio control is being performed.
(ii) The deviation of the air-fuel ratio learned value from the requested learned value is permissible.
(iii) The air-fuel ratio feedback control is being performed.

The following state can be avoided by setting the lower limit guard value GL in consideration of whether the above conditions are satisfied. Namely, it is possible to avoid the state where the actual air-fuel ratio becomes excessively lean because the degree of limitation placed on the air-fuel ratio KGi by the lower limit guard value GL is excessively low, and the state where the actual air-fuel ratio becomes excessively rich because the degree of limitation placed on the air-fuel ratio learned value KGi by the lower limit guard value GL is excessively high.

The degree of limitation placed on the air-fuel ratio learned value KGi by the lower limit guard value GL becomes the highest when the lower limit guard value GL is "0". Namely, correction to the base fuel injection amount Qbse by the air-fuel ratio learned value KGi is not actually made. As the lower limit guard value GL deviates from "0" by a larger amount, the degree of limitation placed on the air-fuel ratio learned value decreases.

As the degree of limitation placed on the air-fuel ratio learned value KGi increases, the base fuel injection amount Qbse is corrected by the air-fuel ratio learned value KGI by a larger amount. Namely, the difference between the fuel injection amount before correction using the air-fuel ratio learned value KGi is made (the base fuel injection amount Qbse before being multiplied by the air-fuel ratio learned value KGi) and the fuel injection amount after correction using the air-fuel ratio learned value KGi is made (the base fuel injection amount Qbse after being multiplied by the air-fuel ratio learned value KGi) becomes less, as the degree of limitation placed on the air-fuel ratio learned value KGi increases.

In the embodiment, the operating state is classified into the operating states (A) to (D) based on the above-mentioned conditions (i) to (ii). Then, the lower limit guard value GL is set for each operating state.

In the operating state (A), the condition (i) is satisfied.
In the operating state (B), the condition (i) is not satisfied but the condition (ii) is satisfied.
In the operating state (C), neither the condition (i) nor the condition (ii) is satisfied, but the condition (iii) is satisfied.
In the operating state (D), none of the conditions (i), (ii) and (iii) are satisfied.

Hereafter, how the lower limit guard value GL is set in each operating state will be described in detail.

In the operating state (A), the fuel injection amount is corrected using the feedback correction coefficient FAF, and the air-fuel ratio learned value KGi is updated. Therefore, even if the air-fuel ratio learned value KGi significantly deviates from the required learned value, the actual air-fuel ratio does not become excessively leaner than the stoichiometric air-fuel ratio. Accordingly, the lower limit guard value GL is not set. If a request to set the lower limit guard value GL is additionally made, the lower limit guard value GL may be set according to the request.

In the operating state (B), the deviation of the air-fuel ratio learned value KGi from the requested learned value is permissible. Accordingly, misfire, which occurs because the fuel is not vaporized from the lubricating oil, does not occur. However, when the engine is cold and the air-fuel ratio learned value KGi is not updated, misfire may occur because the good combustion state cannot be realized. At the permissible deviation, the air-fuel ratio does not become excessively lean even if the fuel is not vaporized from the lubricating oil.

In consideration of this, in the "learned value guard routine", the lower limit guard value GL, which can suppress occurrence of misfire in the operating state (B), is set to a first guard value GdA. In the embodiment, the first guard value GdA is calculated using a first guard value calculation map in FIG. 8. Namely, the first guard value GdA is calculated using the coolant temperature THW as a parameter. In the first guard value calculation map, as the coolant temperature THW increases, the absolute value of the first guard value GdA increases.

In the operating state (C), the deviation of the air-fuel ratio learned value KGi from the requested learned value is not permissible. Accordingly, the actual air-fuel ratio may become excessively leaner than the stoichiometric air-fuel ratio. Meanwhile, because the fuel injection amount is corrected using the feedback correction coefficient FAF, the deviation of the air-fuel ratio learned value KGi from the required learned value is compensated to some extent by the feedback correction coefficient FAF. However, because the guard value is set for the feedback correction coefficient FAF, and updating of the air-fuel ratio learned value KGi is stopped, compensation for the deviation of the actual air-fuel ratio made by the feedback correction coefficient FAF is limited.

In consideration of this, in the "learned value guard routine", the lower limit guard value GL, which can suppress occurrence of misfire in the operating state (C), is set to a second guard value GdB. In the embodiment, the second guard value GdB is calculated using a second guard value calculation map in FIG. 9. Namely, the second guard value GdB is calculated using the coolant temperature THW as a parameter. In the second guard value calculation map, as the coolant temperature THW increases, the absolute value of the second guard value GdB increases.

In the operating state (D), the deviation of the air-fuel ratio learned value KGi from the requested learned value is not permissible. Accordingly, the actual air-fuel ratio may become excessively leaner than the stoichiometric air-fuel ratio. In addition, because correction to the fuel injection amount using the feedback correction coefficient FAF is not made, compensation for the deviation of the air-fuel ratio learned value KGi from the requested learned value using the feedback correction coefficient FAF is not made.

In consideration of this, in the "learned value guard routine", the lower limit guard value GL, which can suppress occurrence of misfire in the operating state (D), is set to a third guard value GdC. In the embodiment, the third guard value GdC is calculated using a third guard value calculation map in FIG. 10. Namely, the third guard value GdC is calculated using the coolant temperature THW and a dilution-fuel amount FD (that is an estimated amount of fuel mixed in the lubricating oil), as parameters. In the third guard value calculation map, as the coolant temperature THW increases, the absolute value of the third guard value GdC increases.

Figure 11:
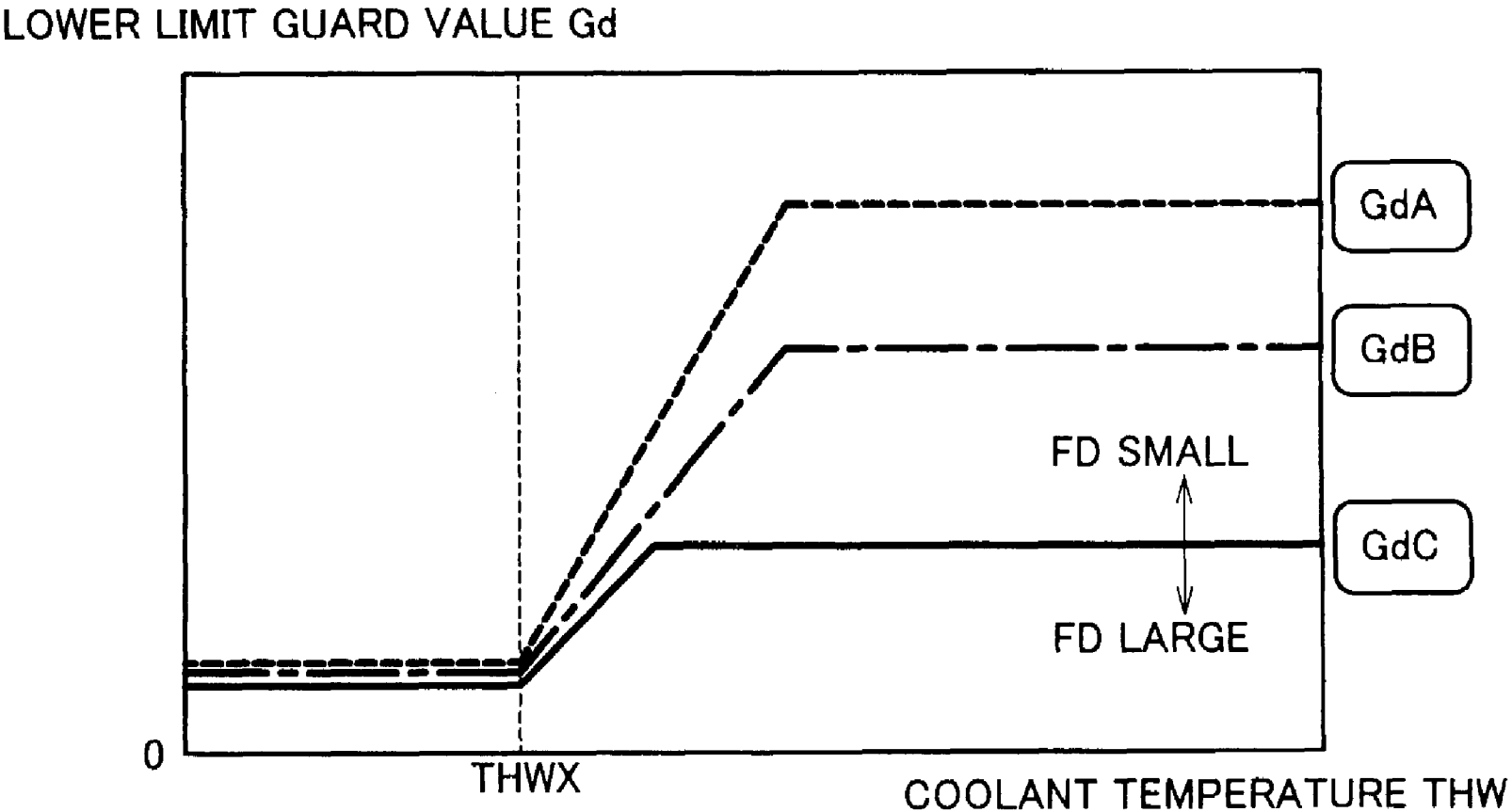
FIG. 11 illustrates the graph showing the relationship among the guard values calculated through the "learned value guard routine" according to the embodiment.

Next, the relationship among the guard values will be described. FIG. 11 illustrates the relationship among the guard values. In the engine 1, it becomes more difficult for the fuel to be atomized, as the coolant temperature THW decreases. Therefore, each guard value is set so as to come closer to "0" as the coolant temperature THW decreases. Namely, as the coolant temperature THW decreases, the degree of limitation placed on the air-fuel ratio learned value KGi by the lower limit guard value GL increases. When the coolant temperature THW is lower than a reference coolant temperature THWX, misfire due to excessively lean air-fuel ratio is more likely to occur regardless of the operating states classified as described above. Accordingly, each guard value is set to a small value.

In the operating state (D), correction to the fuel injection amount using the feedback correction coefficient FAF is not made. Therefore, the deviation of the air-fuel ratio learned value KGi from the requested learned value causes the actual air-fuel ratio to become leaner than the stoichiomtric air-fuel ratio by a larger amount than in the operating state (C). Accordingly, the third guard value GdC is set to a value closer to "0" than the second guard value GdB is (set to a value that places a higher degree of limitation on the air-fuel ratio learned value KGi than the second guard value GdB does).

In the operating state (B), because the deviation of the air-fuel ratio learned value KGi from the required learned value is permissible, the degree to which the actual air-fuel ratio becomes excessively leaner than the stoichiometric air-fuel ratio is lower than in the operating state (C). Accordingly, the first guard value GdA is set to a value apart from "0" than the second guard value GdB is (set to the value that places a lower degree of limitation on the air-fuel ratio learned value KGi than the second guard value GdB does). The first guard value GdA and the second guard value GdB may be set to the same value.

Figure 12B:
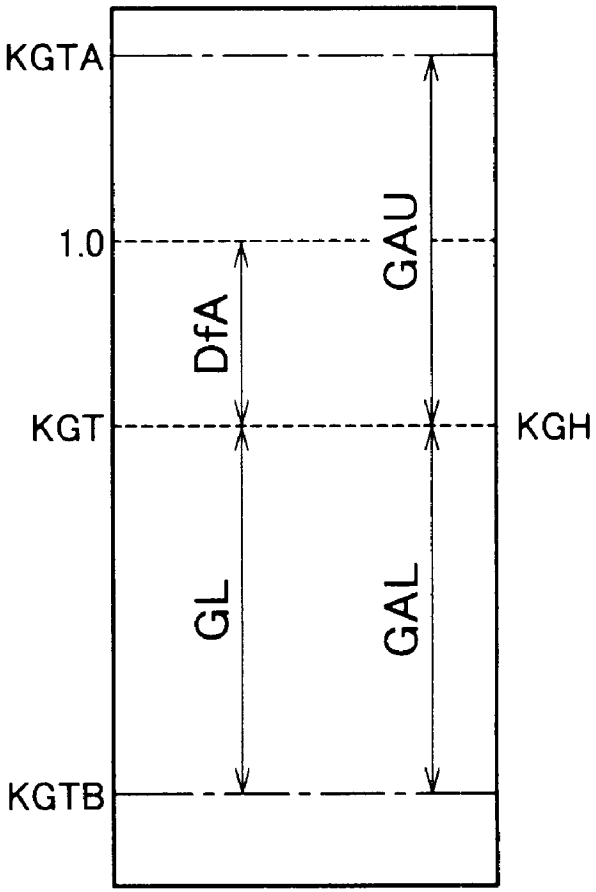
FIGS. 12A and 12B illustrate the relationship between the air-fuel ratio learned value and the requested learned value.
Figure 12A:
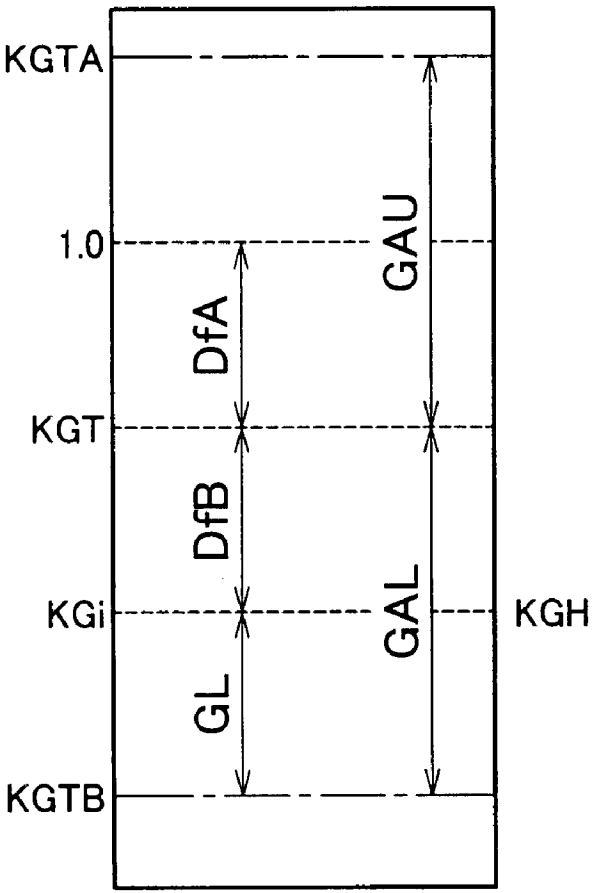

With reference to FIGS. 12A and 12B, the relationship between the third guard value GdC and the dilution-fuel amount FD will be described. FIG. 12A shows the case where the present air-fuel ratio learned value KGi deviates from a requested learned value KGT because the fuel is not vaporized from the lubricating oil.

In this case, if the air-fuel ratio learned value KGi is in the predetermined range whose center value is the requested learned value KGT, namely, the range from an upper limit requested learned value KGTA (requested learned value KGT+predetermined value "A") to a lower limit requested learned value KGTB (requested learned value KGT−predetermined value "A"), deterioration of combustion state, for example, occurrence of misfire can be avoided regardless of whether the air-fuel ratio feedback control and the air-fuel ratio learning control are performed/stopped. Namely, when the present air-fuel ratio learned value KGi deviates from the requested learned value KGT, occurrence of misfire, etc. can be suppressed by setting an upper limit guard value GU and the lower limit guard value GL to values within the predetermined range.

If the actual air-fuel ratio tends to be constantly deviated from the stoichiometric air-fuel ratio for only the following two reasons:

(a) the individual difference of the injection characteristics in the injector 3A; and (b) vaporization of the fuel from the lubricating oil;

the requested learned value KGT is set to a value that compensates for only the deviation of the actual air-fuel ratio for the reason (a). Namely, the requested learned value KGT is set to a value that is smaller than the reference value "1.0" of the air-fuel ratio learned value by the amount corresponding to (a) (fuel injection characteristic learned value DfA). Meanwhile, the air-fuel ratio learned value KGi is set to a value that compensates for the deviation of the actual air-fuel ratio for the reasons (a) and (b). Namely, the air-fuel ratio learned value KGi is set to a value that is smaller than the reference value "1.0" of the air-fuel ratio learned value by the amount obtained by adding the amount corresponding to (a) (fuel injection characteristic learned value DfA) to the amount corresponding to (b) (vaporization learned value DfB).

Accordingly, if the present air-fuel ratio learned value KGi deviates from the requested learned value KGT because the fuel is not vaporized from the lubricating oil, the deviation (vaporization learned value DfB) corresponds to the amount of fuel vaporized from the lubricating oil when the air-fuel ratio learned value KGi is updated (the amount of fuel that is vaporized from the lubricating oil and supplied to the combustion chamber 24). Because the amount of fuel vaporized from the lubricating oil is correlated with the dilution fuel amount FD, the vaporization learned value DfB may be regarded as the value corresponding to the dilution-fuel amount FD.

When the fuel is vaporized from the lubricating oil, as the engine load becomes higher and the fuel injection amount becomes greater, the influence of the fuel mixed in the lubricating oil on the actual air-fuel ratio becomes less. Accordingly, the high load learned value KGH is the value closest to the requested learned value KGT, from among a plurality of the air-fuel ratio learned values KGi. Meanwhile, when the guard value for the air-fuel ratio learned value KGi is set, it is preferable to use the requested learned value KGT as the reference. However, because the requested learned value KGT is not an actually obtained value, it is appropriate to use the high load learned value KGH as the reference.

As shown in FIG. 12B, when the high load learned value KGH matches the requested learned value KGT, the upper limit guard value GU for the air-fuel ratio learned value KGi becomes equal to the upper limit requested guard value KGTA. Namely, the upper limit guard value GU becomes equal to the absolute value of the difference between the upper limit requested learned value KGTA and the requested learned value KGT (upper limit side guard amount GAU). Also, the lower limit guard value GL becomes equal to the lower limit requested learned value KGTB. Namely, the lower limit guard value GL becomes equal to the absolute value of the difference between the lower limit requested learned value KGTB and the requested learned value KGT (lower limit side guard amount GAL).

If the high load learned value KGH deviates from the requested learned value KGT because the fuel is not vaporized from the lubricating oil (see FIG. 12A), as the vaporization learned value DfB increases, the lower limit guard value GL when the high load learned value KGH is used as the reference decreases. Namely, when the lower limit guard value GL is set using the high load learned value KGH as the reference, the lower limit guard value GL needs to be decreased in accordance with the increase in the vaporization learned value DfB to make the lower limit guard value GL equal to or less than the lower limit side guard amount GAL.

The vaporization learned value DfB is correlated with the dilution-fuel amount FD, as described above. Therefore, the lower limit guard value GL (the third guard value GdC) can be appropriately made equal to or less than the lower limit guard amount GAL by setting the lower limit guard value GL (the third guard value) based on the dilution-fuel amount FD. Accordingly, in the embodiment, the third guard value GdC is set using the dilution-fuel amount FD that can be obtained based on the engine operating state, etc, as the parameter.

The third guard value calculation map is set in the above-mentioned manner. Therefore, in the third guard value calculation map, as the dilution-fuel amount FD increases, the third guard value GdC changes toward "0", that is, the third guard value GdC tends to change such that the degree of limitation placed on the air-fuel ratio learned value KGi increases. Also in the second guard value calculation map, the second guard value GdB is set based basically on the above-mentioned concept. The second guard value GdB is set to a value that is more apart from "0" than the third guard value GdC is, that is, a value that places lower degree of limitation on the air-fuel ratio learned value KGi than the third guard value GdC does, in consideration of the degree of correction to the fuel injection amount made by using the feedback correction coefficient FAF.

Figure 13:
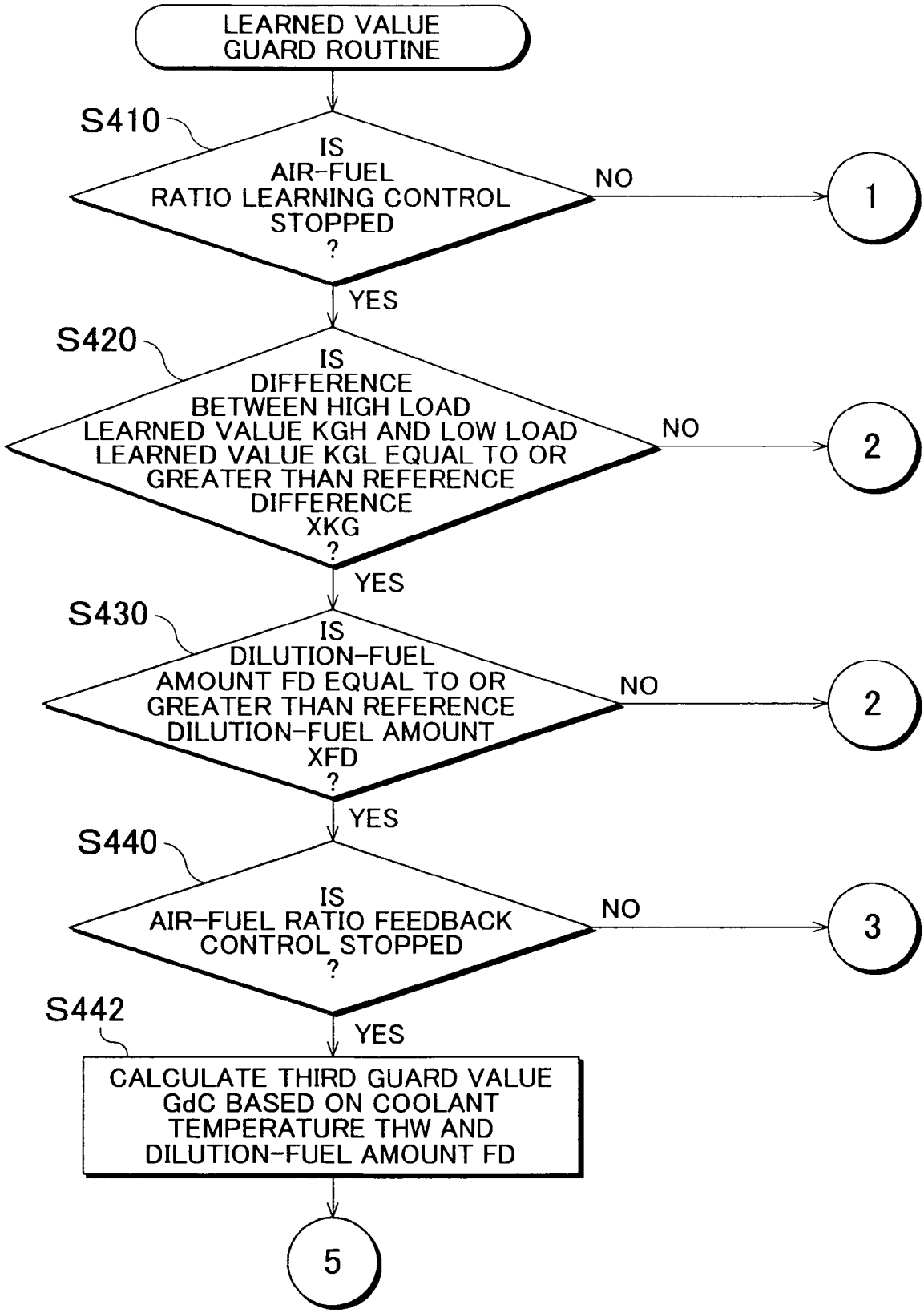
FIG. 13 illustrates the flowchart showing a part of the "learned value guard routine" used for the internal combustion engine according to the embodiment, which is performed by the electronic control unit.
Figure 14:
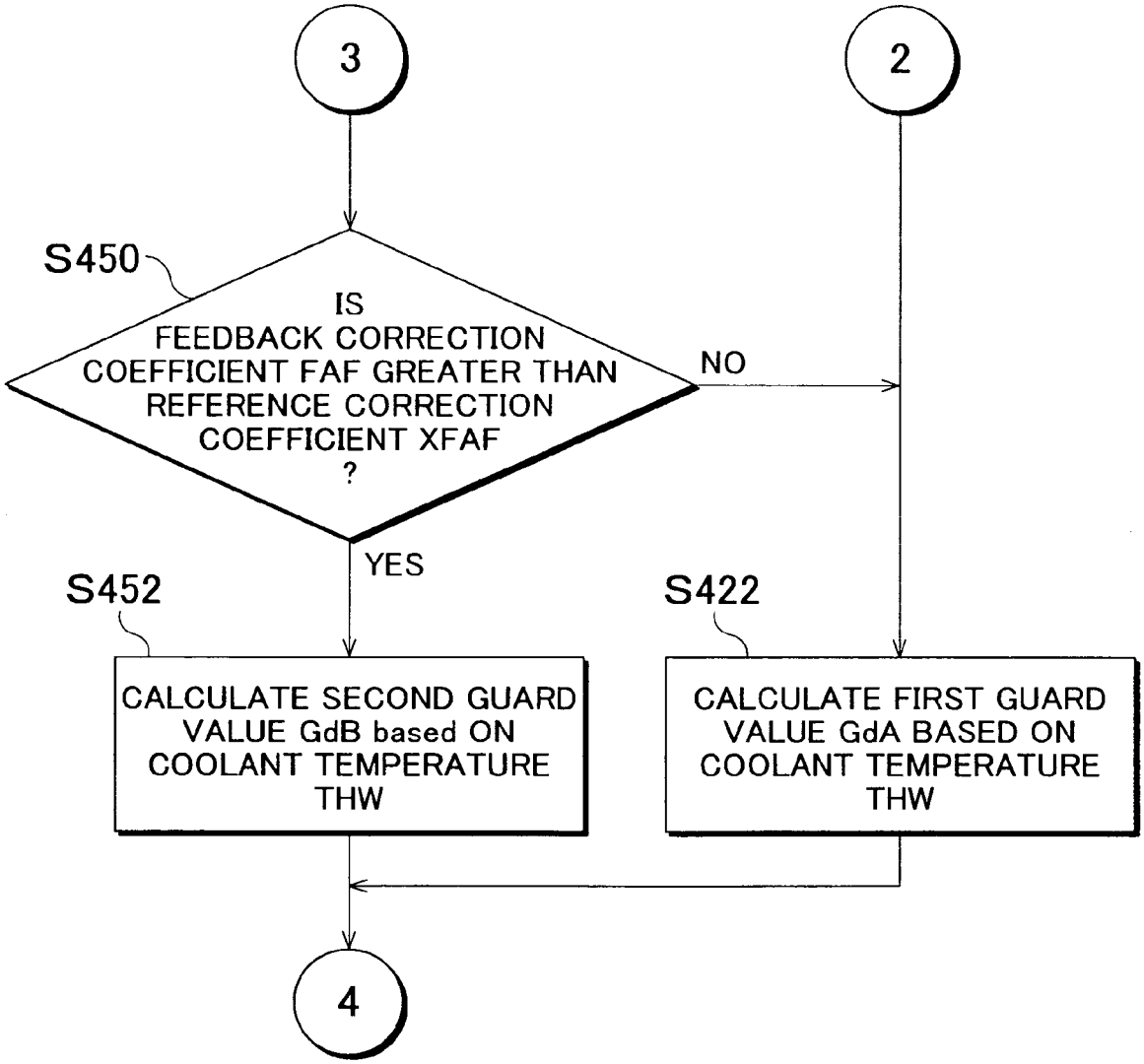
FIG. 14 illustrates the flowchart showing a part of the "learned value guard routine" used for the internal combustion engine according to the embodiment, which is performed by the electronic control unit.
Figure 15:
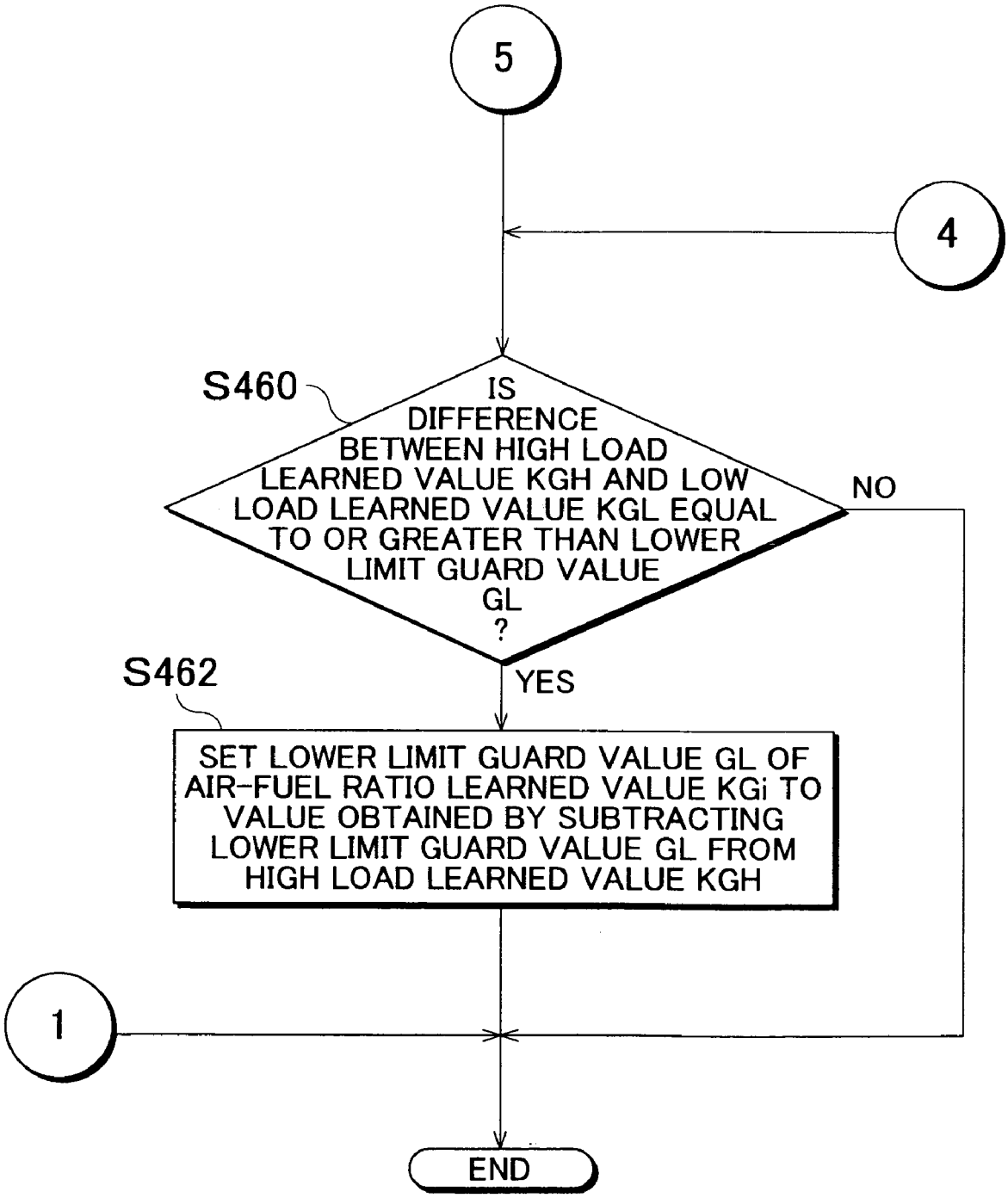
FIG. 15 illustrates the flowchart showing a part of the "learned value guard routine" used for the internal combustion engine according to the embodiment, which is performed by the electronic control unit.

With reference to FIGS. 13 to 15, the "learned value guard routine" will be described. The ECU 9 performs the "learned value guard routine" at predetermined time intervals.

In step S410, the ECU 9 determines whether the air-fuel ratio learning control (air-fuel ratio learning routine) is stopped. The ECU 9 then determines whether the actual air-fuel ratio may become excessively leaner than the stoichiometric air-fuel ratio based on the determination made in step S410.

If the air-fuel ratio learning control is performed, the ECU 9 determines that the actual air-fuel ratio does not become excessively leaner than the stoichiometric air-fuel ratio. When such a determination is made, the ECU 9 ends the learned value guard routine.

On the other hand, if the air-fuel ratio learning control is not performed, the ECU 9 determines that the actual air-fuel ratio may become excessively leaner than the stoichiometric air-fuel ratio. When such a determination is made, the ECU 9 performs step S420.

In step S420, the ECU 9 determines whether the absolute value of the difference between the high load learned value KGH and the low load learned value KGL (learned value difference ΔKG) is equal to or greater than a reference difference XKG The ECU 9 then determines whether the present air-fuel ratio learned value KGi is a value that is obtained by updating the air-fuel ratio learned value KGi while the fuel is vaporized from the lubricating oil, based on the determination made in step S420.

If the learned value difference ΔKG is equal to or grater than the reference difference XKG, the ECU 9 determines that the present air-fuel ratio learned value KGi is a value that is obtained by updating the air-fuel ratio learned value KGi while the fuel is vaporized from the lubricating oil. Namely, the ECU 9 determines that the actual air-fuel ratio may become excessively leaner than the stoichiometric air-fuel ratio because the fuel is currently not vaporized from the lubricating oil. When such a determination is made, the ECU 9 performs step S430.

On the other hand, if the learned value difference ΔKG is less than the reference difference XKG, the ECU 9 determines that the present air-fuel ratio learned value KGi is a value that is obtained by updating the air-fuel ratio learned value KGi when the fuel is not vaporized from the lubricating oil. Namely, the ECU 9 determines that there is no possibility that the actual air-fuel ratio becomes excessively leaner than the stoichiometric air-fuel ratio because the fuel is currently not vaporized from the lubricating oil. When such a determination is made, the ECU 9 performs step S422. If a negative determination is made in step S420, namely, when the dilution-fuel amount FD is less than a reference dilution fuel amount XFD, the operating state is (B).

When the fuel vaporized from the lubricating oil is supplied to the combustion chamber 24, the degree of influence of the fuel mixed in the lubricating oil on the actual air-fuel ratio, namely, the air-fuel ratio learned value KGi varies depending on the load of the engine 1. When the engine 1 is running at low load, the fuel injection amount is less than that when it is running at high load. Accordingly, the air-fuel ratio learned value KGi (low load learned value KGL) is less than the high load learned value KGH. The difference between the low load learned value KGL and the high load learned value KGH tends to increase as the amount of fuel vaporized from the lubricating oil and supplied to the combustion chamber 24 increases. Therefore, the above-mentioned determination can be made concerning the air-fuel ratio learned value KGi based on the determination made in step S420.

In step S422, the lower limit guard value GL is set. Here, the first guard value GdA is calculated by applying the coolant temperature THW to the first guard value calculation map in FIG. 8. Then, the lower limit guard value GL is set to the first guard value GdA.

In step S430, the ECU 9 determines whether the degree to which the lubricating oil has been diluted with the fuel is higher than the reference degree. In this case, whether the degree to which the lubricating oil has been diluted with the fuel is higher than the reference degree is determined based on the result of comparison between the dilution-fuel amount FD and the reference dilution-fuel amount XFD, with reference to the estimated value (dilution-fuel amount FD) of the dilution-fuel amount that is obtained through another routine. The dilution-fuel amount FD can be obtained based on the temperature of the cylinder 21 or the index value thereof.

The ECU 9 then determines whether the present air-fuel ratio learned value KGi is a value that changes the actual air-fuel ratio a value excessively leaner than the stoichiometric air-fuel ratio, based on the determination made in step S430.

If the dilution-fuel amount FD is equal to or greater than the reference dilution-fuel amount XFD, the ECU 9 determines that the air-fuel ratio learned value KGi is a value that changes the actual air-fuel ratio to a value excessively leaner than the stoichiometric air-fuel ratio when the fuel is not vaporized from the lubricating oil. Namely, the ECU 9 determines that misfire may occur because the fuel is not vaporized from the lubricating oil. When such a determination is made, the ECU 9 performs step S440.

On the other hand, if the dilution-fuel amount FD is less than the reference dilution-fuel amount XFD, the ECU 9 determines that the air-fuel ratio learned value KGi is not a value that changes the actual air-fuel ratio to a value excessively leaner than the stoichiometric air-fuel ratio when the fuel is not vaporized from the lubricating oil. Namely, the ECU 9 determines that there is no possibility that misfire occurs because the fuel is not vaporized from the lubricating oil. When such a determination is made, the ECU 9 performs step S422. When a negative determination is made in step S430, namely, when the dilution-fuel amount FD is less than the reference dilution-fuel amount XFD, the operating state is "B".

In step S440, the ECU 9 determines whether the air-fuel ratio feedback control (air-fuel ratio feedback routine) is stopped. The ECU 9 then determines whether the lower limit guard value GL needs to be set to the third guard value GdC, based on the determination made in step S440.

If the air-fuel ratio feedback control is not performed, the ECU 9 determines that the lower limit guard value GL needs to be set to the third guard value GdC. When such a determination is made, the ECU 9 performs step S442.

On the other hand, if the air-fuel ratio feedback process is performed, the ECU 9 determines the lower limit guard value GL need not be set to the third guard value GdC. When such a determination is made, the ECU 9 performs step S450.

In step S442, the lower limit guard value GL is set. Here, the third guard value GdC is calculated by applying the dilution-fuel amount FD and the coolant temperature THW to the third guard value calculation map in FIG. 10. Then, the lower limit guard value GL is set to the third guard value GdC.

In step S450, the ECU 9 determines whether the feedback correction coefficient FAF is greater than a reference correction coefficient XFAF. The electronic control unit 9 makes the following determination concerning the actual air-fuel ratio based on the determination made in step S450.

If the feedback-correction coefficient FAF is greater than the reference correction coefficient XFAF, namely, if the feedback correction coefficient FAF is set to a value that increases the base fuel injection amount Qbse, the ECU 9 determines that the actual air-fuel ratio is leaner than the stoichiometric air-fuel ratio. Namely, the ECU 9 determines that the air-fuel ratio learned value KGi is set to a value less than the required learned value because the fuel is not vaporized from the lubricating oil. When such a determination is made, the ECU 9 performs step S452.

On the other hand, if the feedback-correction coefficient FAF is equal to or less than the reference correction coefficient XFAF, namely, if the feedback correction coefficient FAF is set to a value that decreases the base fuel injection amount Qbse, the ECU 9 determines that the actual air-fuel ratio is not leaner than the stoichiometric air-fuel ratio. Namely, the ECU 9 determines that the state, where the present air-fuel ratio learned value KGi is set to a value less than the required learned value because the fuel is not vaporized from the lubricating oil, is not realized. When such a determination is made, the ECU 9 performs step S422.

In step S452, the lower limit guard value GL is set. Here, the second guard value GdB is calculated by applying the coolant temperature THW to the second guard value calculation map in FIG. 9. Then, the lower guard value GL is set to the second guard value GdB.

In step S460, the ECU 9 determines whether the absolute value of the difference between the high load learned value KGH and the low load learned value KGL (hereinafter, referred to as the "learned value difference ΔKG") is equal to or greater than the lower limit guard value GL. The ECU 9 then determines whether the lower limit guard value GL needs to be set, based on the determination made in step S460.

If the learned value difference ΔKG is equal to or greater than the lower limit guard value GL, the air-fuel ratio learned value KGi may be less than the lower limit guard value GL. Accordingly, the ECU 9 determines that the lower limit guard value GL needs to be set. When such a determination is made, the ECU 9 performs step S462.

On the other hand, if the learned value difference ΔKG is less than the lower limit guard value GL, the air-fuel ratio learned value KGi does not become less than the lower limit guard value GL. Accordingly, the ECU 9 determines that the lower limit guard value GL need not be set. When such a determination is made, the ECU 9 ends the learned value guard routine.

In step S462, the lower limit guard value GL is applied to the air-fuel ratio learned value KGi. Here, the lower limit guard value GL of the final air-fuel ratio learned value KGi is set to a value obtained by subtracting the lower limit guard value GL from the high load learned value KGH. Namely, the lower limit guard value GL is applied using the high load learned value KGH as the reference. The upper limit guard value GU is set through another routine.

The air-fuel ratio learned value KGi is limited as follows by the guard values, that are, the upper limit guard value GU and the lower limit guard value GL.

The upper limit of the air-fuel ratio learned value KGi is limited by the upper limit guard value GU. Namely, when the air-fuel ratio learned value KGi is set to a value equal to or greater than the upper limit guard value GU, the air-fuel ratio learned value KGi is set to a value equal to the upper limit guard value GU, and then the final fuel injection amount Qfin is calculated.

The lower limit of the air-fuel ratio learned value KGi is limited by the lower limit guard value GL. Namely, when the air-fuel ratio learned value KGi is set to a value equal to or less than the lower limit guard value GL, the air-fuel ratio learned value KGi is set to a value equal to the lower limit guard value GL, and then the final fuel injection amount Qfin is calculated.

As described so far in detail, the air-fuel ratio control apparatus for an internal combustion engine according to the embodiment produces the following effects.

In the embodiment, the third guard value GdC that is the lower limit guard value GL when the air-fuel ratio feedback control is not performed is set based on the dilution-fuel amount FD. Thus, misfire that occurs because the actual air-fuel ratio becomes excessively leaner than the stoichiometric air-fuel ratio can be suppressed.

In the embodiment, the lower limit guard value GL is set such that the degree of limitation placed on the air-fuel ratio learned value KGi by the lower limit guard value GL when the air-fuel ratio feedback control is not performed is higher than that when the air-fuel ratio feedback control is performed. Thus, misfire that occurs because the actual air-fuel ratio becomes excessively leaner than the stoichiometric air-fuel ratio can be appropriately suppressed.

The above-mentioned embodiment can be appropriately modified as follows.

In the above-mentioned embodiment, the third guard value GdC is changed based on the dilution-fuel amount FD. However, the third guard value GdC may be changed based on the difference between an actual degree, to which the fuel has been actually vaporized from the lubricating oil, and an estimated degree, to which the fuel has been vaporized from the lubricating oil, the estimated degree being estimated based on a degree to which lubricating oil has been diluted with fuel. The degree to which the fuel has been vaporized from the lubricating oil can be estimated based on the temperature of the lubricating oil or the index value thereof.

In the above-mentioned embodiment, the air-fuel ratio control apparatus for an internal combustion engine according to the invention is applied to a direct injection type internal combustion engine. However, the air-fuel ratio control apparatus may be applied to a port injection type internal combustion engine in which fuel is injected toward the intake port.

While the invention is described with reference to exemplary embodiments thereof, it should be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single element, are also within the sprit and scope of the invention.

What is claimed is:

1. An air-fuel ratio control apparatus for an internal combustion engine, comprising:

a control unit that calculates an air-fuel ratio learned value, which indicates a constant variance in a difference of an actual air fuel ratio from a target air fuel ratio, the control unit calculates a guard value to limit the air fuel ratio learned value, based on a degree to which lubricating oil has been diluted with fuel, the control unit limits the air fuel ratio learned value based on the guard value, and the control unit calculates a fuel injection amount using the air fuel ratio learned value limited by the guard value.

2. The air-fuel ratio control apparatus for an internal combustion engine according to claim 1, wherein the control unit calculates the guard value such that the degree of correction to the fuel injection amount made by using the air-fuel ratio learned value decreases, as the degree to which the lubricating oil has been diluted with the fuel increases.

3. The air-fuel ratio control apparatus for an internal combustion engine according to claim 2, wherein the control unit enables a limitation placed on the air-fuel ratio learned value by the guard value, when updating of the air-fuel ratio learned value is prohibited.

4. The air-fuel ratio control apparatus for an internal combustion engine according to claim 3, wherein the control unit disables the limitation placed on the air-fuel ratio learned value by the guard value, when updating of the air-fuel ratio learned value is permitted.

5. The air-fuel ratio control apparatus for an internal combustion engine according to claim 1, wherein the control unit enables a limitation placed on the air-fuel ratio learned value by the guard value, when updating of the air-fuel ratio learned value is prohibited.

6. The air-fuel ratio control apparatus for an internal combustion engine according to claim 5, wherein the control unit disables the limitation placed on the air-fuel ratio learned value by the guard value, when updating of the air-fuel ratio learned value is permitted.

7. The air-fuel ratio control apparatus for an internal combustion engine according to claim 1, wherein the control unit disables a limitation placed on the air-fuel ratio learned value by the guard value, when updating of the air-fuel ratio learned value is permitted.

8. The air-fuel ratio control apparatus for an internal combustion engine according to claim 1, wherein the control unit uses the guard value to place the limitation on the degree of correction made to decrease the fuel injection amount.

9. An air-fuel ratio control apparatus for an internal combustion engine, comprising:

a control unit that calculates an air-fuel ratio learned value, which indicates a constant variance in a difference of an actual air fuel ratio from a target air fuel ratio, the control unit calculates a guard value to limit the air fuel ratio learned value, based on a degree to which fuel has been vaporized from lubricating oil, the control unit limits the air fuel ratio learned value based on the guard value, and the control unit calculates a fuel injection amount using the air fuel ratio learned value limited by the guard value.

10. The air-fuel ratio control apparatus for an internal combustion engine according to claim 9, wherein the control unit calculates the guard value such that the degree of correction to the fuel injection amount made by using the air-fuel ratio learned value decreases with an increase in a difference between an actual degree, to which the fuel has been actually vaporized from the lubricating oil, and an estimated degree, to which the fuel has been vaporized from the lubricating oil, the estimated degree being estimated based on a degree to which lubricating oil has been diluted with fuel.

11. The air-fuel ratio control apparatus for an internal combustion engine according to claim 10, wherein the control unit enables a limitation placed on the air-fuel ratio learned value by the guard value, when updating of the air-fuel ratio leamed value is prohibited.

12. The air-fuel ratio control apparatus for an internal combustion engine according to claim 11, wherein the control unit disables the limitation placed on the air-fuel ratio learned value by the guard value, when updating of the air-fuel ratio learned value is permitted.

13. The air-fuel ratio control apparatus for an internal combustion engine according to claim 9, wherein the control unit enables a limitation placed on the air-fuel ratio learned value by the guard value, when updating of the air-fuel ratio learned value is prohibited.

14. The air-fuel ratio control apparatus for an internal combustion engine according to claim 13, wherein the control unit disables the limitation placed on the air-fuel ratio learned value by the guard value, when updating of the air-fuel ratio learned value is permitted.

15. The air-fuel ratio control apparatus for an internal combustion engine according to claim 9, wherein the control unit disables a limitation placed on the air-fuel ratio learned value by the guard value, when updating of the air-fuel ratio learned value is permitted.

16. The air-fuel ratio control apparatus for an internal combustion engine according to claim 9, wherein the control unit uses the guard value to place the limitation on the degree of correction made to decrease the fuel injection amount.

17. An air-fuel ratio control apparatus for an internal combustion engine, comprising:

a control unit that calculates an air-fuel ratio feedback correction value and an air-fuel ratio learned value, which indicates a constant variance in a difference of an actual air fuel ratio from a target air fuel ratio, the control unit calculates a guard value to limit the air fuel ratio learned value, the control unit performs air-fuel ratio feedback control for calculating the air-fuel ratio feedback correction value and air-fuel ratio learning control for calculating the air-fuel ratio learned value, and the control unit limits the air fuel ratio learned value based on the guard value when the air-fuel ratio learning control is not performed, wherein a degree of limitation placed on the air-fuel ratio learned value by the guard value when the air-fuel ratio feedback control is not performed is set to a value higher than a degree of limitation placed on the air-fuel ratio learned value when the air-fuel ratio feedback control is performed.

18. The air-fuel ratio control apparatus for an internal combustion engine according to claim 17, wherein the control unit changes the degree of limitation placed on the air-fuel ratio learned value by the guard value, based on a degree to which lubricating oil has been diluted with fuel.

19. The air-fuel ratio control apparatus for an internal combustion engine according to claim 17, wherein the control unit changes the degree of limitation placed on the air-fuel ratio learned value by the guard value, based on a degree to which fuel has been vaporized from lubricating oil.

20. The air-fuel ratio control apparatus for an internal combustion engine according to claim 17, wherein the control unit uses the guard value to place the limitation on the degree of correction made to decrease the fuel injection amount.

21. An air-fuel ratio control apparatus for an internal combustion engine, comprising:

a control unit that calculates an air-fuel ratio learned value, which indicates a constant variance in a difference of an actual air fuel ratio from a target air fuel ratio, the control unit calculates a guard value to limit the air fuel ratio learned value, the control unit limits the air fuel ratio learned value based on the guard value, when detecting that fuel is not vaporized from lubricating oil, under a condition that a present air-fuel ratio learned value is a value obtained by updating the air-fuel ratio leaned value while the fuel is vaporized from the lubricating oil, and the control unit calculates a fuel injection amount using the air fuel ratio learned value limited by the guard value.

22. The air-fuel ratio control apparatus for an internal combustion engine according to claim 21, wherein the control unit changes a degree of limitation placed on the air-fuel ratio learned value by the guard value, based on a degree to which the lubricating oil has been diluted with the fuel.

23. The air-fuel ratio control apparatus for an internal combustion engine according to claim 21, wherein the control unit changes a degree of limitation placed on the air-fuel ratio learned value by the guard value, based on a degree to which the fuel has been vaporized from the lubricating oil.

24. The air-fuel ratio control apparatus for an internal combustion engine according to claim 21, wherein the control unit uses the guard value to place the limitation on the degree of correction made to decrease the fuel injection amount.

* * * * *